US011227537B2

(12) United States Patent
Yoon et al.

(10) Patent No.: US 11,227,537 B2
(45) Date of Patent: Jan. 18, 2022

(54) DISPLAY DEVICE FOR MASKING CLOCK SIGNALS IN DIFFERENT MODES

(71) Applicant: Samsung Display Co., Ltd., Yongin-si (KR)

(72) Inventors: Chang Noh Yoon, Yongin-si (KR); Hae Kwan Seo, Yongin-si (KR); Won Tae Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/829,954

(22) Filed: Mar. 25, 2020

(65) Prior Publication Data

US 2021/0027697 A1 Jan. 28, 2021

(30) Foreign Application Priority Data

Jul. 26, 2019 (KR) ..... 10-2019-0091244

(51) Int. Cl.
*G09G 3/32* (2016.01)

(52) U.S. Cl.
CPC ..... *G09G 3/32* (2013.01); *G09G 2330/021* (2013.01)

(58) Field of Classification Search
CPC ..... G09G 3/32
USPC ..... 345/213
See application file for complete search history.

(56) References Cited

U.S. PATENT DOCUMENTS

| | | | | |
|---|---|---|---|---|
| 9,489,882 | B2 | 11/2016 | Kim et al. | |
| 9,823,729 | B2 | 11/2017 | An et al. | |
| 10,395,616 | B2 | 8/2019 | Koo et al. | |
| 2016/0111055 | A1* | 4/2016 | Na | G09G 3/3666 345/212 |
| 2016/0293091 | A1* | 10/2016 | Wang | G11C 19/28 |
| 2017/0287425 | A1* | 10/2017 | Koo | G09G 3/3688 |
| 2021/0035489 | A1 | 2/2021 | Seo et al. | |

FOREIGN PATENT DOCUMENTS

| | | | |
|---|---|---|---|
| CN | 108682392 | A | 10/2018 |
| KR | 10-2016-0052942 | A | 5/2016 |
| KR | 10-2017-0114067 | A | 10/2017 |
| KR | 10-1962860 | B1 | 3/2019 |
| KR | 10-2021-0014258 | A | 2/2021 |

* cited by examiner

*Primary Examiner* — Long D Pham
(74) *Attorney, Agent, or Firm* — Lewis Roca Rothgerber Christie LLP

(57) ABSTRACT

A display device includes a timing controller configured to generate clock signals, a start signal, and image data. A scan driver includes a plurality of stages configured to sequentially output the clock signals as scan signals in response to the start signal. A data driver is configured to generate a data signal based on the image data. A display unit includes pixels configured to emit light with luminance corresponding to the data signal in response to the scan signal. The timing controller is to mask at least one of the clock signals in a first section, a second section, and a third section included in one frame section and spaced from each other.

18 Claims, 20 Drawing Sheets

DISPLAY DEVICE FOR MASKING CLOCK SIGNALS IN DIFFERENT MODES

CROSS-REFERENCE TO RELATED APPLICATION

This application claims priority to and the benefit of Korean Patent Application No. 10-2019-0091244 filed in the Korean Intellectual Property Office on Jul. 26, 2019, the entire content of which is incorporated herein by reference.

BACKGROUND

1. Field

Example embodiments of the present disclosure relate to a display device.

2. Description of the Related Art

A display device includes a display panel and a driver. The display panel includes scan lines, data lines, and pixels. The driver includes a scan driver which sequentially provides scan signals to scan lines and a data driver which provides data signals to data lines. Each of the pixels may emit light with luminance corresponding to a data signal provided through a corresponding data line in response to a scan signal provided through a corresponding scan line.

In order to reduce power consumption, the display device may display only some frame images or drive only a portion of the display panel.

SUMMARY

In order to drive only a region (e.g., partial region) of a display panel, a scan driver may select only scan lines corresponding to the region of the display panel to provide scan signals.

However, because a circuit configuration for selecting only some of the scan lines is added, a circuit configuration of the scan driver may be enlarged and/or complicated.

An example embodiment of the present disclosure provides a display device in which a circuit configuration of a scan driver may be prevented from becoming complicated (or simplified), and power consumption may also be reduced by driving only a region (e.g., a partial region) of a display panel.

A display device according to example embodiments of the present disclosure includes a timing controller configured to generate clock signals, a start signal, and image data; a scan driver which includes a plurality of stages configured to sequentially output the clock signals as scan signals in response to the start signal; a data driver configured to generate a data signal based on the image data; and a display unit which includes a plurality of pixels configured to emit light with luminance corresponding to the data signal in response to the scan signal. The timing controller may mask at least one of the clock signals in a first section, a second section, and a third section included in one frame section and spaced from each other.

According to an example embodiment, each of the plurality of stages may output a clock signal of the clock signals as a scan signal of the scan signals in response to a carry signal, a first stage of the plurality of stages may receive the start signal as the carry signal, and remaining stages of the plurality of stages other than the first stage may receive a scan signal of a previous stage as the carry signal.

According to an example embodiment, the clock signal may include a first clock signal and a second clock signal, the first clock signal may have a pulse waveform, and the second clock signal may have a signal in which the first clock signal is shifted by a half period.

According to an example embodiment, the first stage of the plurality of stages may output the second clock signal as the scan signal, and a second stage of the plurality of stages adjacent to the first stage may output the first clock signal as the scan signal.

According to an example embodiment, in the first section of the frame section, the timing controller may mask at least one of the first clock signal and the second clock signal.

According to an example embodiment, in the first section of the frame section, the timing controller may mask the second clock signal and may not mask the first clock signal.

According to an example embodiment, the second clock signal may include a pulse having a first voltage level between a first time point and a second time point and may be maintained at a second voltage level different from the first voltage level between a third time point and a fourth time point, the first time point, the second time point, the third time point, and the fourth time point may be sequentially spaced by a half period of the second clock signal, and the third time point and the fourth time point may be in the first section.

According to an example embodiment, the first clock signal may include a pulse having the first voltage level between the second time point and the third time point and a pulse having the first voltage level between the fourth time point and a fifth time point, and the fifth time point may be spaced from the fourth time point by a half period of the first clock signal.

According to an example embodiment, the first section may correspond to at least one stage of the plurality of stages.

According to an example embodiment, the first section may be smaller than a period of the first clock signal.

According to an example embodiment, the timing controller may mask at least one of the first clock signal and the second clock signal in the second section.

According to an example embodiment, the second section may be greater than a period of the first clock signal.

According to an example embodiment, each of the first clock signal and the second clock signal may have at least one pulse between the second section and the third section.

According to an example embodiment, the timing controller may mask at least one of the first clock signal and the second clock signal in the third section.

According to an example embodiment, the third section may be greater than a period of the first clock signal.

According to an example embodiment, the timing controller may output pulses of a clock signal of the clock signals in a first mode, mask at least one of the pulses of the clock signal in the first section, the second section, and the third section in a second mode, and periodically perform a mode conversion between the first mode and the second mode.

According to an example embodiment, each of the plurality of pixels may include a light-emitting element; a first transistor that includes a first electrode connected to a first power source, a second electrode connected to a first node, a gate electrode connected to a second node, and a body to which a common control voltage is applied; a second transistor configured to transmit the data signal to the second node in response to a scan signal of the scan signals; and a third transistor connecting the first node to the light-emitting element.

According to an example embodiment, the common control voltage having a first voltage level may be applied to the pixels in the first mode, and the common control voltage having a second voltage level different from the first voltage level may be applied to some of the pixels in the second mode.

According to an example embodiment, the display unit may include a first pixel region and a second pixel region separated from each other, each of first pixels provided in the first pixel region among the pixels may be connected to a first common control line to receive the common control voltage, and each of second pixels provided in the second pixel region among the pixels may be connected to a second common control line to receive the common control voltage.

A display device according to example embodiments of the present disclosure includes a timing controller configured to generate a first clock signal, a second clock signal, a start signal, and image data; a scan driver which includes a plurality of stages, wherein each of the stages sequentially outputs a first scan signal corresponding to the start signal based on the first clock signal and a second scan signal corresponding to the first scan signal based on the second clock signal; a data driver configured to generate a data signal based on the image data; and a display unit which includes pixels, wherein each of the pixels is initialized in response to the first scan signal and emits light with luminance corresponding to the data signal in response to the second scan signal. The timing controller may mask at least one of the first clock signal and the second clock signal in a first section included in one frame section.

DETAILED DESCRIPTION

Figure 1:
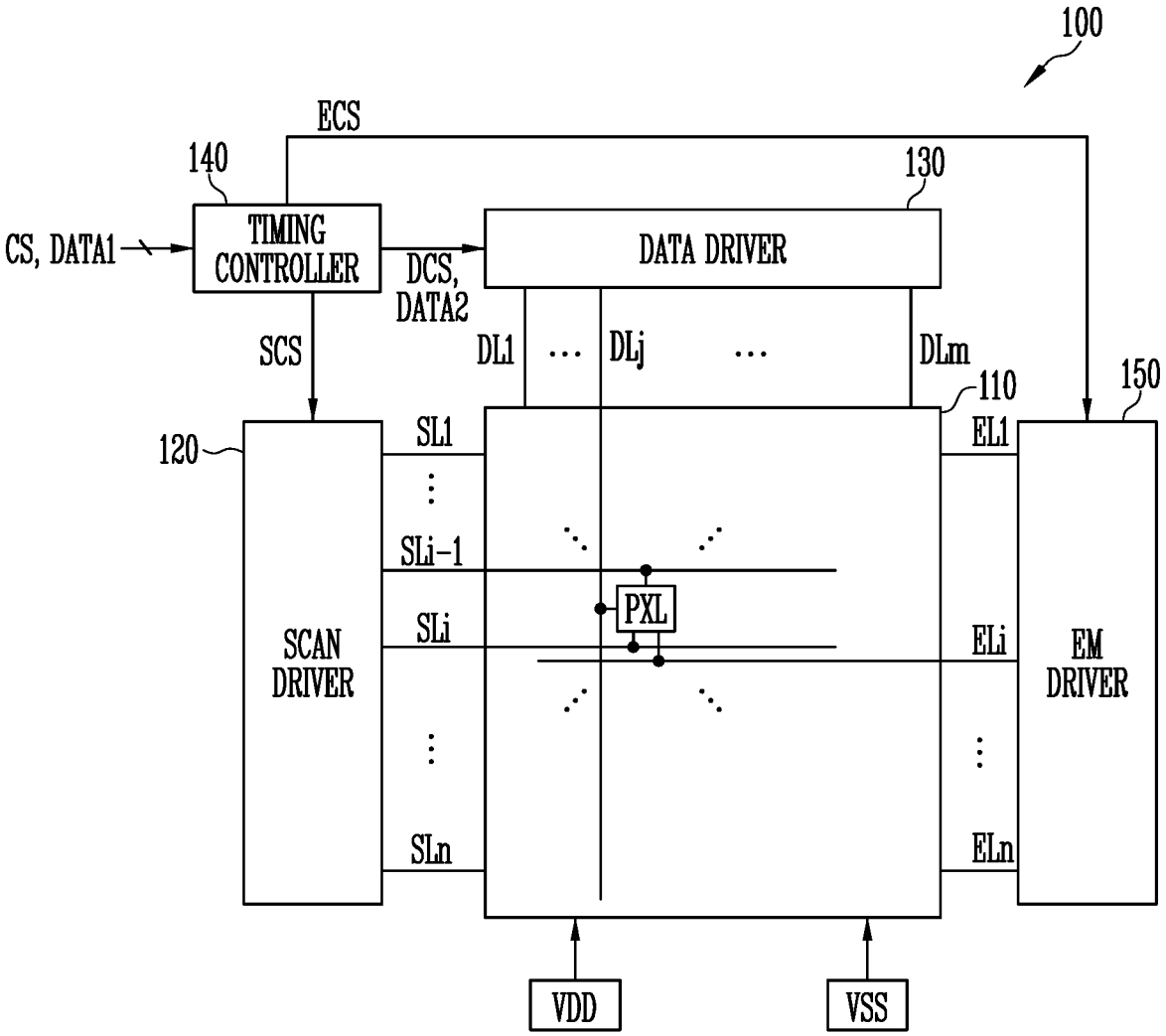
FIG. 1 is a block diagram illustrating a display device according to an example embodiment of the present disclosure.

The present disclosure can be variously modified in various example embodiments and specific example embodiments will be described and shown in the drawings. However, the present disclosure is not limited to the example embodiments described herein, and may be implemented in various different forms.

In the present disclosure, a portion of constituents that is not directly related to features of the present disclosure may be omitted in order to clearly illustrate the different example embodiments of the present disclosure. In addition, some components in the drawings may be shown in exaggerated sizes, ratios, and the like. In the drawings, the same or similar components are denoted by the same reference numerals and signs as possible although they are shown in different drawings, and redundant descriptions thereof will be omitted.

Figure 2:
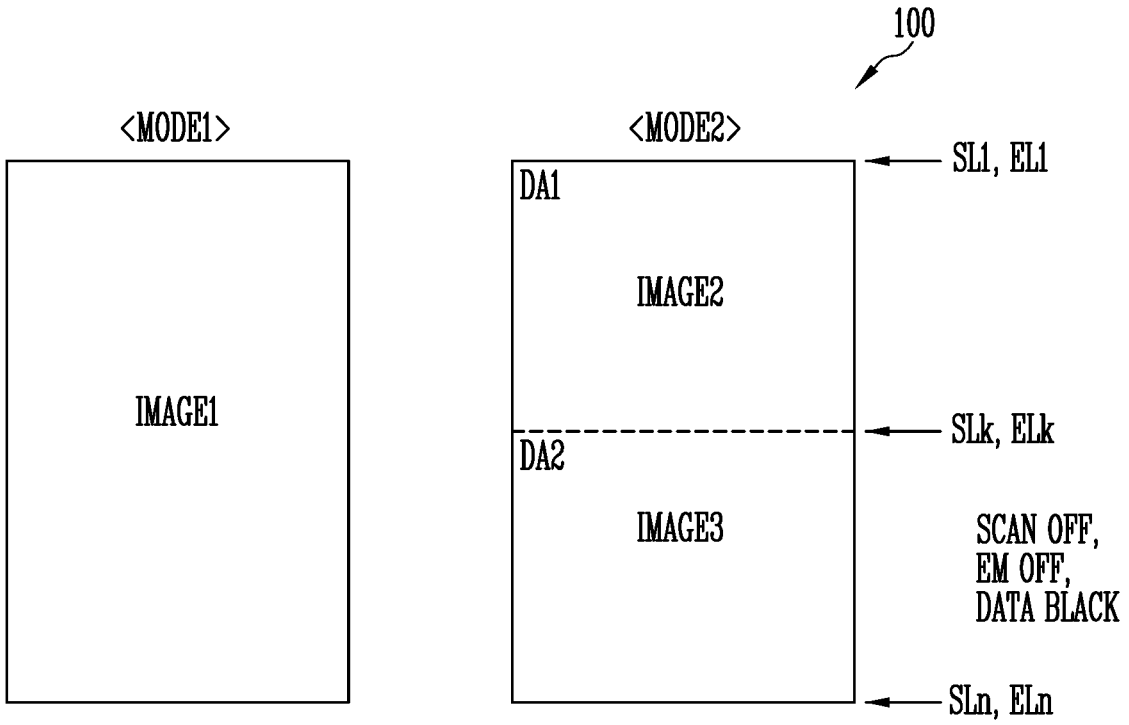
FIG. 2 is a diagram illustrating an example of driving modes of the display device of FIG. 1.

FIG. 1 is a block diagram illustrating a display device according to an example embodiment of the present disclosure. FIG. 2 is a diagram illustrating an example of driving modes of the display device of FIG. 1.

Referring to FIG. 1, a display device 100 may include a display unit 110 (or a display panel), a scan driver 120 (or a gate driver), a data driver 130 (or a source driver), a timing controller 140, and an emission driver 150 (or an EM driver).

The display unit 110 may include scan lines SL1 to SLn (or gate lines), data lines DL1 to DLm, emission control lines EL1 to ELn, and a pixel PXL, wherein each of n and m is a positive integer. The pixel PXL may be located in regions (for example, pixel regions) divided by the scan lines SL1 to SLn, the data lines DL1 to DLm, and the emission control lines EL1 to ELn.

The pixel PXL may be connected to at least one of the scan lines SL1 to SLn, one of the data lines DL1 to DLm, and at least one of the emission control lines EL1 to ELn. For example, the pixel PXL may be connected to the scan line SLi, a previous scan line SLi−1 adjacent to the scan line SLi, the data line DLj, and the emission control line ELi, wherein each of i and j is a positive integer.

The pixel PXL may be initialized in response to a scan signal (a scan signal provided at a previous time point or a previous gate signal) provided through the previous scan line SLi−1. In addition, the pixel PXL may store or record a data signal provided through the data line DLj in response to a scan signal (a scan signal or a gate signal provided at a current time point) provided through the scan line SLi. Thus, the pixel PXL may emit light with luminance corresponding to the stored data signal in response to an emission control signal provided through the emission control line ELi.

The display unit 110 may receive first and second power voltages VDD and VSS. The power voltages VDD and VSS are voltages used for operation of the pixel PXL. The first power voltage VDD may have a voltage level higher than that of the second power voltage VSS.

The scan driver 120 may generate scan signals based on a scan control signal SCS and may sequentially provide the scan signals to the scan lines SL1 to SLn. Here, the scan control signal SCS may include a scan start signal, scan clock signals, and/or the like and may be provided by the timing controller 140. For example, the scan driver 120 may include a shift register (or a stage) which sequentially generates and outputs pulse scan signals corresponding to a pulse scan start signal using the scan clock signals.

A detailed configuration of the scan driver 120 according to one embodiment will be described below with reference to FIG. 8.

The emission driver 150 may generate emission control signals based on an emission driving control signal ECS and may sequentially provide the emission control signals to the emission control lines EL1 to ELn. The emission driving control signal ECS may include an emission start signal, emission clock signals, and/or the like and may be provided by the timing controller 140. For example, the emission driver 150 may include a shift register that sequentially generates and outputs pulse emission control signals corresponding to a pulse emission start signal using the emission clock signals.

The data driver 130 may generate data signals based on image data DATA2 and a data control signal DCS provided by the timing controller 140 and may provide the data signals to the display unit 110 (e.g., including the pixel PXL). Here, the data control signal DCS may be a signal for controlling operation of the data driver 130 and may include a load signal (or a data enable signal) and/or the like, instructing output of a valid data signal.

The timing controller 140 may receive input image data DATA1 and a control signal CS from the outside (for example, a graphics processor), may generate the scan control signal SCS and the data control signal DCS based on the control signal CS, and may convert the input image data DATA1 to generate the image data DATA2. For example, the timing controller 140 may convert the input image data DATA1 having an RGB format into the image data DATA2 having an RGBG format corresponding to a pixel arrangement in the display unit 110.

In example embodiments, the timing controller 140 may be operated in a first mode and a second mode. Here, the first mode and the second mode may be an operation mode (or operating mode) of the timing controller 140 (or the display device 100).

Referring to FIG. 2, for example, a first mode MODE1 may be a normal mode, and in the first mode MODE1, the display device 100 may display a first image IMAGE1 corresponding to the entirety of the display unit 110. For example, a second mode MODE2 may be a partial driving mode. In the second mode MODE2, the display device 100 may display a second image IMAGE2 (for example, a moving image) in a first display region DA1 of the display unit 110. In addition, the display device 100 may display a third image IMAGE3 (for example, a still image or a low frequency image) or may not display an image in a second display region DA2 of the display unit 110.

Accordingly, in order to display the first image IMAGE1 in the entirety of the display unit 110 in the first mode MODE1, the timing controller 140 may control each of the scan driver 120, the data driver 130, and the emission driver 150 so as to be normally operated. In the present disclosure, in order to display the second image IMAGE2 only in the first display region DA1 of the display unit 110 in the second mode MODE2, the timing controller 140 may control the scan driver 120, the data driver 130, and the emission driver 150 so as to be partially operated. For example, under the control of the timing controller 140, a scan signal SCAN may be provided only to first to (k−1)th scan lines SL1 to SLk−1 corresponding to the first display region DA1 (wherein k is a positive integer) and may not be provided to kth to nth scan lines SLk to SLn (SCAN OFF). Similarly, an emission control signal EM may be provided only to first to (k−1)th emission control lines EL1 to ELk−1 corresponding to the first display region DA1 and may not be provided to kth to nth emission control lines ELk to ELn (EM-OFF). In addition, a normal data signal DATA may be provided to the first display region DA1, and a black data signal DATA BLACK (i.e., a data signal corresponding to a black gray level value) may be provided to the second display region DA2.

The first display region DA1 and the second display region DA2 may be fixed, but the example embodiments of the present disclosure is not limited thereto. For example, when the display device 100 is implemented as a foldable display device, the first display region DA1 and the second display region DA2 may be separated with respect to a folding axis and may be preset. In another example, when the display device 100 is implemented as a general display device and displays a document being edited (which corresponds to the first display region DA1) and an image corresponding to a virtual keyboard (which corresponds to the second display region DA2), sizes of the first and second display regions DA1 and DA2 (or a boundary between the first display region DA1 and the second display region DA2 and a value of k) may be changed.

In an example embodiment, the timing controller 140 may mask at least one of pulses included in a scan clock signal in some sections of one frame section. Here, the one frame section may be a section in which one frame image is displayed. Some sections of a frame section may be a time point at which the scan signal SCAN is supplied to the kth scan line SLk, or a section including the time point.

For example, a scan clock signal may have a first voltage level (for example, a turn-off voltage level for turning a switching element or transistor off) and may have a pulse waveform that periodically transitions to a second voltage level (for example, a turn-on voltage level for turning the switching element or transistor on). The timing controller 140 may skip the transition of the scan clock signal to the second voltage level in some sections. That is, the scan clock signal may have pulses having a turn-on voltage level periodically, and the timing controller 140 may mask, remove, or omit at least one pulse of the scan clock signal in the partial section. Therefore, the scan clock signal may have the first voltage level instead of the second voltage level in the partial section.

In this case, the scan driver 120 may sequentially output pulse scan signals having the second voltage level before some sections of one frame section and then may output scan signals having only the first voltage level in the partial section of one frame section (also, after the partial section). Therefore, only pixels in a partial region of the display unit 110 (i.e., a region corresponding to a section before the partial section of one frame section) may be selected.

In an example embodiment, the timing controller 140 may mask at least one of pulses included in an emission clock signal in a partial region of one frame section. Here, the partial section may be a time point at which the emission control signal EM is supplied to the kth emission control line ELk or a section including the time point and may be the same as or different from a section in which a scan clock signal is masked.

For example, an emission clock signal may have a second voltage level (for example, a turn-on voltage level) and may have a pulse waveform that periodically transitions to a first voltage level (for example, a turn-off voltage level). Those skilled in the art would understand that the voltage levels would be inversed based on the type of transistors being used. The timing controller 140 may skip the transition of the emission clock signal to the first voltage level in some sections. That is, the emission clock signal may have pulses having a turn-off voltage level periodically, and the timing controller 140 may mask or remove at least one pulse of the emission clock signal in some sections. Therefore, the emission clock signal may have the second voltage level instead of the first voltage level in the partial section.

In this case, the emission driver 150 may sequentially output pulse emission control signals having the first voltage level to a part of the emission control lines EL1 to ELn before some sections of one frame section and then may output emission control signals having only the second voltage level (for example, to the emission control lines ELi to ELn) in the partial section of one frame section (also, after the partial section). As will be described below with reference to FIG. 3, while an emission control signal having the first voltage level is supplied to the pixel PXL, the pixel PXL may update a data signal stored therein in response to a scan signal. Therefore, only pixels in a partial region of the display unit 110 (i.e., a region corresponding to a section before the partial section of one frame section) may emit light based on the updated data signal.

A scan signal (i.e., a pulse scan signal having the second voltage level) may be applied to only some of the scan lines SL1 to SLn through a partial masking operation of the timing controller 140 on a scan clock signal. Similarly, an emission control signal (i.e., a pulse emission control signal having the first voltage level) may be applied to only some of the emission control lines EL1 to ELn through a partial masking operation of the timing controller 140 on the emission clock signal.

Therefore, without adding a separate circuit configuration or modifying the scan driver 120 and the emission driver 150, the display device 100 may provide the scan signal to only some of the scan lines SL1 to SLn, may provide the emission control signal to only some of the emission control lines EL1 to ELn, and may partially drive the display unit 110, thereby reducing power consumption.

In the present disclosure, at least one of the scan driver 120, the data driver 130, the timing controller 140, and the emission driver 150 may be located in the display unit 110 or may be implemented as an integrated circuit (IC) to be connected to the display unit 110 through a flexible circuit board. In the present disclosure, at least two of the scan driver 120, the data driver 130, the timing controller 140, and the emission driver 150 may be implemented as one IC.

Figure 3:
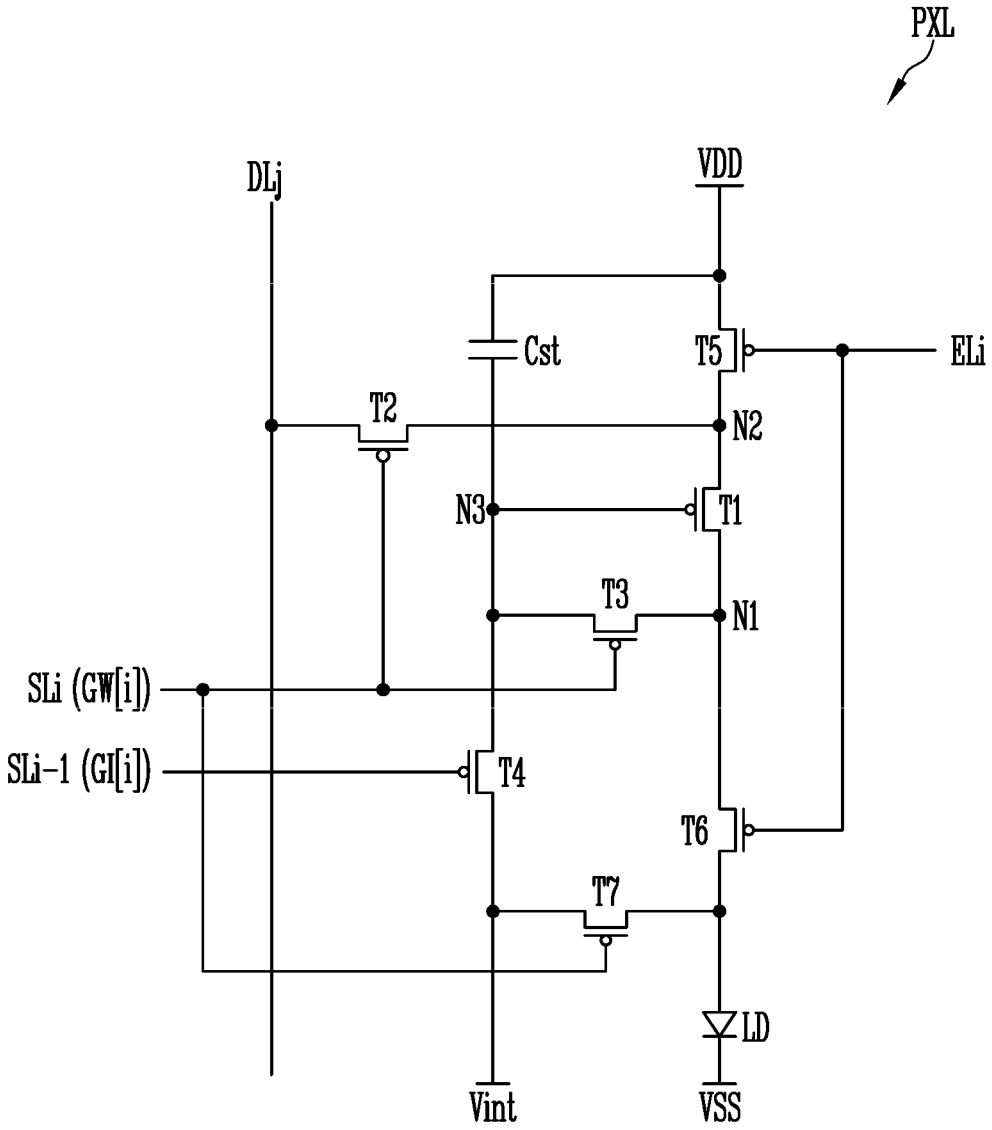
FIG. 3 is a circuit diagram illustrating an example of a pixel included in the display device of FIG. 1.

FIG. 3 is a circuit diagram illustrating an example of a pixel included in the display device of FIG. 1.

Referring to FIG. 3, a pixel PXL may include first to seventh transistors T1 to T7, a storage capacitor Cst, and a light-emitting element LD.

Each of the first to seventh transistors T1 to T7 may be implemented as a p-type transistor, but the present disclosure is not limited thereto. For example, at least some of the first to seventh transistors T1 to T7 may be implemented as an n-type transistor, and those of ordinary skill in the art would understand that different suitable voltage levels are to be applied thereto when different types of transistors are used.

A first electrode of the first transistor T1 (e.g., a driving transistor) may be connected to a second node N2 or may be connected to a first power line through the fifth transistor T5. A second electrode of the first transistor T1 may be connected to a first node N1 or may be connected to an anode of the light-emitting element LD through the sixth transistor T6. A gate electrode of the first transistor T1 may be connected to a third node N3. The first transistor T1 may control an amount of a current flowing to a second power line (i.e., a power line for transmitting a second power voltage VSS) from the first power line (i.e., a power line for transmitting a first power voltage VDD) through the light-emitting element LD in response to a voltage of the third node N3.

The second transistor T2 may be connected between a data line DLj and the second node N2. A gate electrode of the second transistor T2 may be connected to a scan line SLi. When a scan signal (e.g., a second scan signal or a gate signal GW[i]) is supplied to the scan line SLi, the second transistor T2 may be turned on to electrically connect the data line DLj to the first electrode of the first transistor T1.

The third transistor T3 may be connected between the first node N1 and the third node N3. A gate electrode of the third transistor T3 may be connected to the scan line SLi. When the scan signal (e.g., a second scan signal or a gate signal GW[i]) is supplied to the scan line SLi, the third transistor T3 may be turned on to electrically connect the first node N1 and the third node N3. Therefore, when the third transistor T3 is turned on, the first transistor T1 may be connected in the form of a diode (i.e., the first transistor T1 is diode connected).

The storage capacitor Cst may be connected between the first power line and the third node N3. The storage capacitor Cst may store a voltage corresponding to a data signal and a threshold voltage of the first transistor T1.

The fourth transistor T4 may be connected between the third node N3 and an initialization power line (i.e., a power line for transmitting an initialization power voltage Vint). A gate electrode of the fourth transistor T4 may be connected to a previous scan line SLi−1. When a scan signal (e.g., a first scan signal or a gate initialization signal GI[i]) is supplied to the previous scan line SLi−1, the fourth transistor T4 may be turned on to transmit the initialization power voltage Vint to the third node N3 and to the first node N1. Here, the initialization power voltage Vint may be set to have a voltage level lower than that of a data signal. In other words, the initialization power voltage Vint may have a voltage level that is lower than that of the lowest voltage level of the data signal.

The fifth transistor T5 may be connected between the first power line and the second node N2. A gate electrode of the fifth transistor T5 may be connected to an emission control line ELi. The fifth transistor T5 may be turned off (e.g., when the emission control signal is at a first level or high level) when an emission control signal is supplied to the emission control line ELi, and may be turned on otherwise (e.g., when the emission control signal is at a second level or low level).

The sixth transistor T6 may be connected between the first node N1 and the anode of the light-emitting element LD. A gate electrode of the sixth transistor T6 may be connected to the emission control line ELi. The sixth transistor T6 may be turned off when the emission control signal is supplied to the emission control line ELi, and may be turned on otherwise. By way of example, when the fifth transistor T5 is a p-type transistor as shown in FIG. 3, when the emission control signal is supplied, the emission control line ELi is applied with a high level voltage (e.g., a turn-off voltage).

The seventh transistor T7 may be connected between the initialization power line and the anode of the light-emitting element LD. A gate electrode of the seventh transistor T7 may be connected to the scan line SLi. When the scan signal (e.g., second scan signal or gate signal GW[i]) is supplied to the scan line SLi, the seventh transistor T7 may be turned on to supply the initialization power voltage Vint to the anode of the light-emitting element LD.

The anode of the light-emitting element LD may be connected to the first transistor T1 through the sixth transistor T6, and a cathode thereof may be connected to the second power line. The light-emitting element LD may generate light (e.g., light with certain luminance) in response to a current supplied from the first transistor T1. The first power voltage VDD may be set to have a higher voltage level than that of the second power voltage VSS so that a current flows to (and through) the light-emitting element LD.

Figure 4:
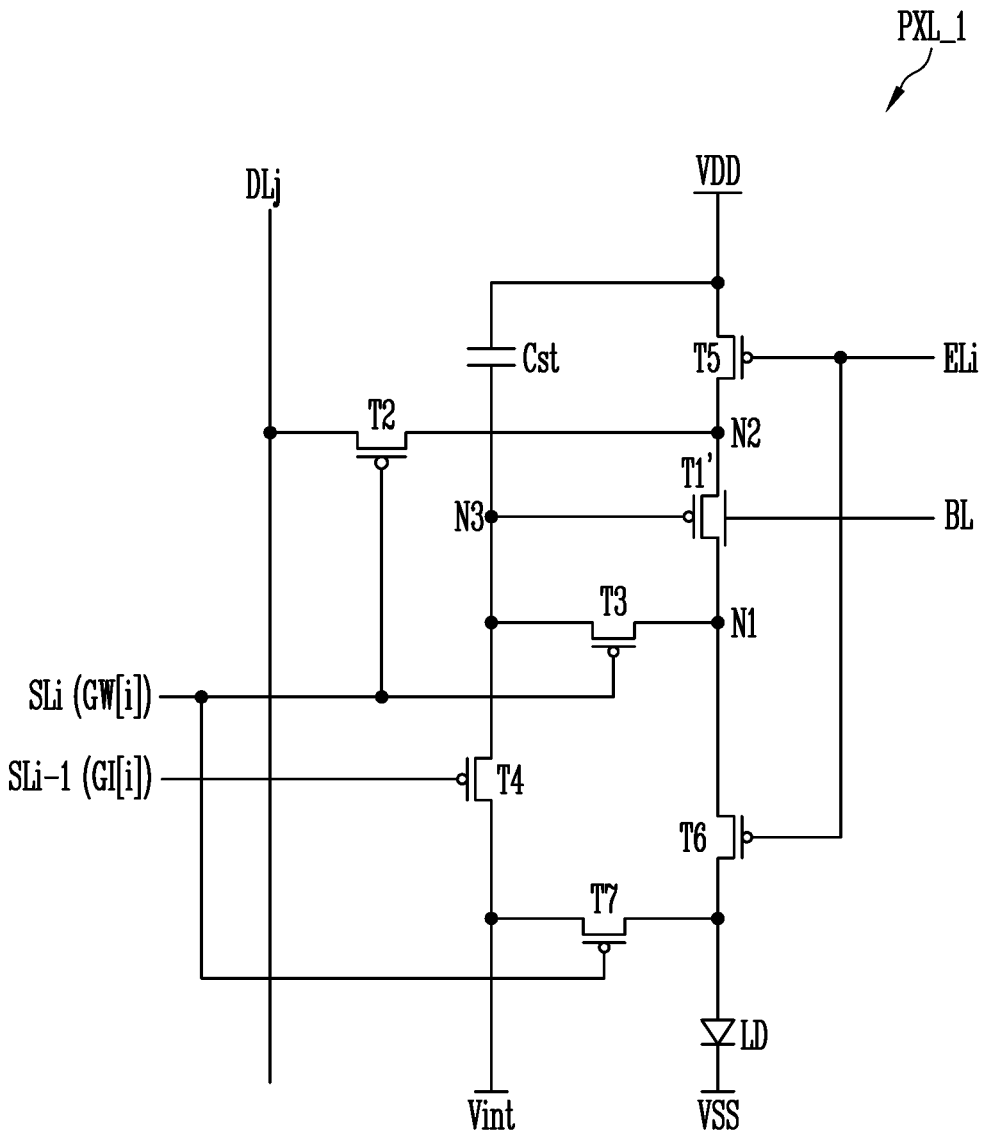
FIG. 4 is a circuit diagram illustrating another example of a pixel included in the display device of FIG. 1.

FIG. 4 is a circuit diagram illustrating another example of a pixel included in the display device of FIG. 1.

Referring to FIGS. 3 and 4, a pixel PXL_1 of FIG. 4 is different from the pixel PXL of FIG. 3 in that the pixel PXL_1 includes a first transistor T1' instead of the first transistor T1 of FIG. 3. Because the pixel PXL_1 of FIG. 4 is substantially the same as or similar to the pixel PXL of FIG. 3 except for the first transistor T1', redundant descriptions thereof may be omitted.

A first electrode of the first transistor T1' may be connected to a second node N2 or may be connected to a first power line through a fifth transistor T5. A second electrode of the first transistor T1' may be connected to a first node N1 (e.g., may be connected to an anode of a light-emitting element LD through a sixth transistor T6). A gate electrode of the first transistor T1' may be connected to a third node N3. In addition, a body (or a body electrode) of the first transistor T1' may be connected to a common control line BL. Here, as will be described below with reference to FIG. 6, the common control line BL may be connected to the data driver 130 (or the timing controller 140). A first power voltage VDD (or a voltage corresponding thereto) or a gate-off voltage may be selectively applied to the common control line BL. For example, the gate-off voltage may be a voltage having a voltage level higher than a voltage level of the first power voltage VDD.

For example, when the first power voltage VDD is applied to the body of the first transistor T1', the first transistor T1' may be operated substantially the same as the first transistor T1 shown in FIG. 3. In another example, when the gate-off voltage is applied to the body of the first transistor T1', an electric field may be formed or developed in the body of the first transistor T1', and thus, a channel of the first transistor T1' may be decreased. In addition, the first transistor T1' may be turned off regardless of a voltage applied to the gate electrode thereof.

For reference, the display unit 110 described with reference to FIGS. 1 and 2 may be integrally implemented to include the first display region DA1 and the second display region DA2, and thus, the second display region DA2 may not be turned off only independently of the first display region DA1. In order to make the second display region DA2 to appear to be turned off, a reference voltage corresponding to a black gray level value may be applied to the second display region DA2 (or the pixel PXL_1 located in the second display region DA2) of the display unit 110. However, in order to apply the reference voltage to the second display region DA2, power consumption may occur in the data driver 130. Therefore, in the display device 100 according to example embodiments of the present disclosure, the gate-off voltage may be applied to the body of the first transistor T1' positioned in the second display region DA2, and thus, power consumption of the data driver 130 may be reduced while an image is not displayed in the second display region DA2.

A more detailed configuration of the first transistor T1' will be described with reference to FIG. 5.

Figure 5:
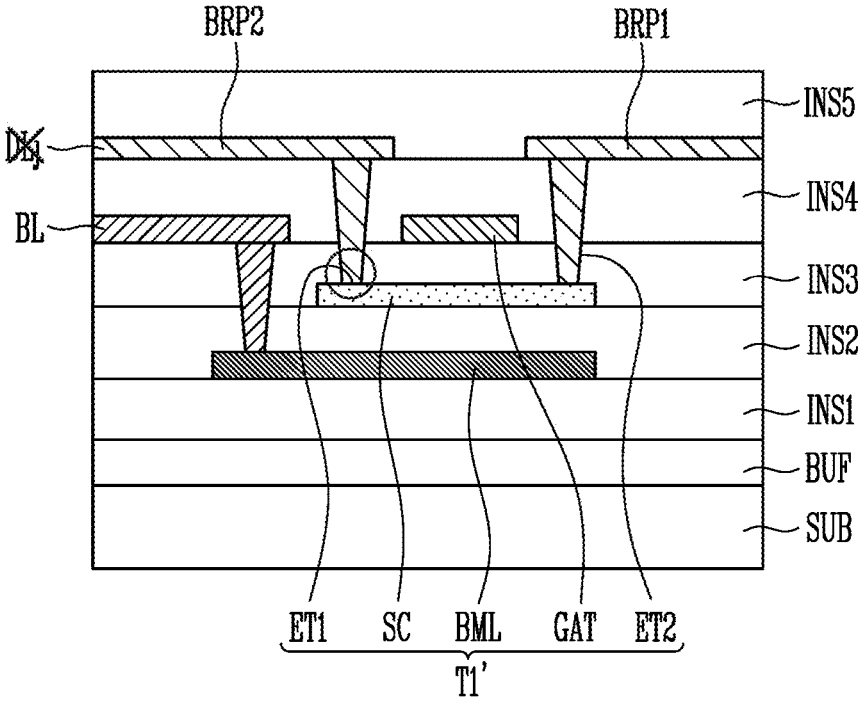
FIG. 5 is a cross-sectional view illustrating an example of a first transistor included in the pixel of FIG. 4.

FIG. 5 is a cross-sectional view illustrating an example of the first transistor T1' included in the pixel of FIG. 4.

Referring to FIGS. 4 and 5, the first transistor T1' (included in the pixel PXL_1 or the display unit 110) may include a substrate SUB, a buffer layer BUF, insulating layers INS1, INS2, INS3, INS4, and INS5, a semiconductor pattern SC, and conductive patterns GAT, BML, BRP1, and BRP2. Also, the first transistor T1' is not directly connected to the data line DLj.

The substrate SUB may constitute a base member of the pixel PXL_1 (or the display unit 110). The substrate SUB may be a rigid substrate or a flexible substrate, and the material and physical properties thereof are not limited to any particular embodiments or example.

The buffer layer BUF may be located on the substrate SUB and may prevent impurities from diffusing into circuit elements. The buffer layer BUF may include a single layer but may also include two or more multiple layers. According to some example embodiments, the buffer layer BUF may be omitted.

The insulating layers INS1, INS2, INS3, INS4, and INS5 may be sequentially placed on the substrate SUB (or the buffer layer BUF) and may include a first insulating layer INS1 (or a first gate insulating film), a second insulating layer INS2 (or a first interlayer insulating film), a third insulating layer INS3 (or a second gate insulating film), a fourth insulating layer INS4 (or a second interlayer insulating film), and a fifth insulating layer INS5 (or a passivation film).

Each of the insulating layers INS1, INS2, INS3, INS4, and INS5 may include a single layer or multiple layers and may include at least one inorganic insulating material and/or organic insulating material. For example, each of the insulating layers INS1, INS2, INS3, INS4, and INS5 may include various types of organic/inorganic insulating materials such as currently known $SiN_x$, and the structural material of each of the insulating layers INS1, INS2, INS3, INS4, and INS5 is not particularly limited. In addition, the insulating layers INS1, INS2, INS3, INS4, and INS5 may include different insulating materials, or at least some of the insulating layers INS1, INS2, INS3, INS4, and INS5 may include the same insulating material.

The conductive patterns GAT, BML, BRP1, and BRP2 may include a gate electrode GAT (or a gate electrode pattern), a body electrode BML (or a body electrode pattern), a first bridge pattern BRP1, and a second bridge pattern BRP2. In addition, the conductive patterns may further include a common control line BL and a data line DLj.

Each of the gate electrode GAT, the body electrode BML, the first bridge pattern BRP1, the second bridge pattern BRP2, the common control line BL, and the data line DLj may include one material selected from among silver (Ag), magnesium (Mg), aluminum (Al), platinum (Pt), palladium (Pd), gold (Au), nickel (Ni), neodymium (Nd), iridium (Ir), chromium (Cr), titanium (Ti), and alloys thereof, but the present disclosure is not limited thereto.

The body electrode BML may be located on the first insulating layer INS1.

The semiconductor pattern SC may be located on the second insulating layer INS2. In an example, the semiconductor pattern SC may be located between the second insulating layer INS2 and the third insulating layer INS3. The semiconductor pattern SC may include a first region in contact with a first transistor electrode ET1, a second region in contact with a second transistor electrode ET2, and a channel region positioned between the first region and the second region. One of the first and second regions may be a source region, and the other thereof may be a drain region.

The semiconductor pattern SC may be a semiconductor pattern made of polysilicon, amorphous silicon, low temperature poly silicon (LTPS), or the like. The channel region of the semiconductor pattern SC may be an intrinsic semiconductor, i.e., a semiconductor pattern that is not doped with impurities, and each of the first and second regions of the semiconductor pattern SC may be semiconductor patterns doped with certain impurities.

The semiconductor pattern SC may overlap the body electrode BML, and the body electrode BML may overlap at least one region of the semiconductor pattern SC.

The gate electrode GAT may be located on the third insulating layer INS3. In an example, the gate electrode GAT may be located between the third insulating layer INS3 and the fourth insulating layer INS4. The gate electrode GAT may overlap at least one region of the semiconductor pattern SC.

The gate electrode GAT, the semiconductor pattern SC, the body electrode BML, and the first and second transistor electrodes ET1 and ET2 may constitute a first transistor T1'.

In addition, the common control line BL may be located on the third insulating layer INS3 and may be connected to the body electrode BML through a contact hole passing through the second and third insulating layers INS2 and INS3. The arrangement position of the common control line BL is not limited thereto, and for example, the common control line BL may be located on the fourth insulating layer INS4.

The first bridge pattern BRP1, the second bridge pattern BRP2, and the data line DLj may be located on the fourth insulating layer INS4.

The first bridge pattern BRP1 may be in contact with one region of the semiconductor pattern SC through a contact hole passing through the third and fourth insulating layers INS3 and INS4 and may constitute the second transistor electrode ET2 of the first transistor T1'. The first bridge pattern BRP1 is connected to the light-emitting element LD (see FIG. 3) on the fifth insulating layer INS5 and may constitute the first node N1 described with reference to FIG. 3.

The second bridge pattern BRP2 may be in contact with one region of the semiconductor pattern SC through a contact hole passing through the third and fourth insulating layers INS3 and INS4 and may constitute the first transistor electrode ET1 of the first transistor T1'.

As described with reference to FIG. 4, the second bridge pattern BRP2 may connect the first electrode of the first transistor T1' and the second electrode of the fifth transistor T5. In addition, the second bridge pattern BRP2 may be connected to the data line DLj through the second transistor T2 and may constitute the second node N2.

However, the structure of the first transistor T1' described with reference to FIG. 5 is merely an example. The structure of the first transistor T1' may be variously modified as long as the first transistor T1' has a structure including a body electrode.

Figure 6:
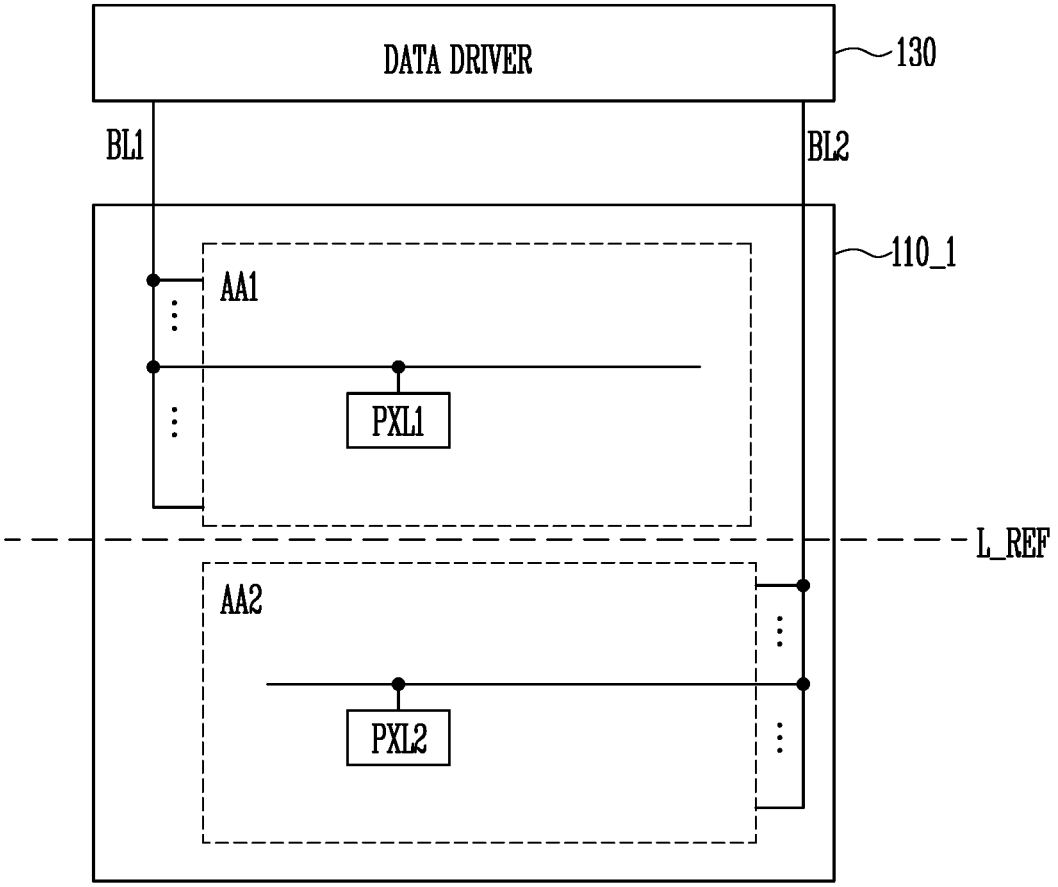
FIG. 6 is a diagram illustrating an example of a display unit included in the display device of FIG. 1.

FIG. 6 is a diagram illustrating an example of a display unit included in the display device of FIG. 1.

Referring to FIGS. 1 and 6, a display unit 110_1 shown in FIG. 6 is different from the display unit 110 shown in FIG. 1 in that the display unit 110_1 further includes a first common control line BL1 and a second common control line BL2. Because the display unit 110_1 is substantially the same as or similar to the display unit 110 shown in FIG. 1 except for the first and second common control lines BL1 and BL2, redundant descriptions thereof may be omitted.

The display unit 110_1 may include a first active region AA1 and a second active region AA2. The first active region AA1 and the second active region AA2 may be regions provided with pixels PXL1 and PXL2 and may respectively correspond to the first display region DA1 and the second display region DA2 described with reference to FIG. 2. A first pixel PXL1 may be provided in the first active region AA1, and a second pixel PXL2 may be provided in the second active region AA2.

The first active region AA1 and the second active region AA2 may be divided from each other with respect to a reference line L_REF and may have substantially the same area. For example, when the display unit 110_1 is implemented as a foldable display panel, the first active region AA1 and the second active region AA2 may be divided from each other with respect to a folding axis.

The first common control line BL1 may be located in the first active region AA1 and may be connected to the first pixel PXL1. All pixels located in the first active region AA1 may be commonly connected to the first common control line BL1. As described above, a first power voltage VDD or a gate-off voltage may be selectively applied to the first common control line BL1 from the data driver 130.

Similarly, the second common control line BL2 may be located in the second active region AA2 and may be connected to the second pixel PXL2. All pixels located in the second active region AA2 may be commonly connected to the second common control line BL2.

The control of the display unit 110_1 through the common control lines BL1 and BL2 will be described with reference to FIG. 7.

Figure 7:
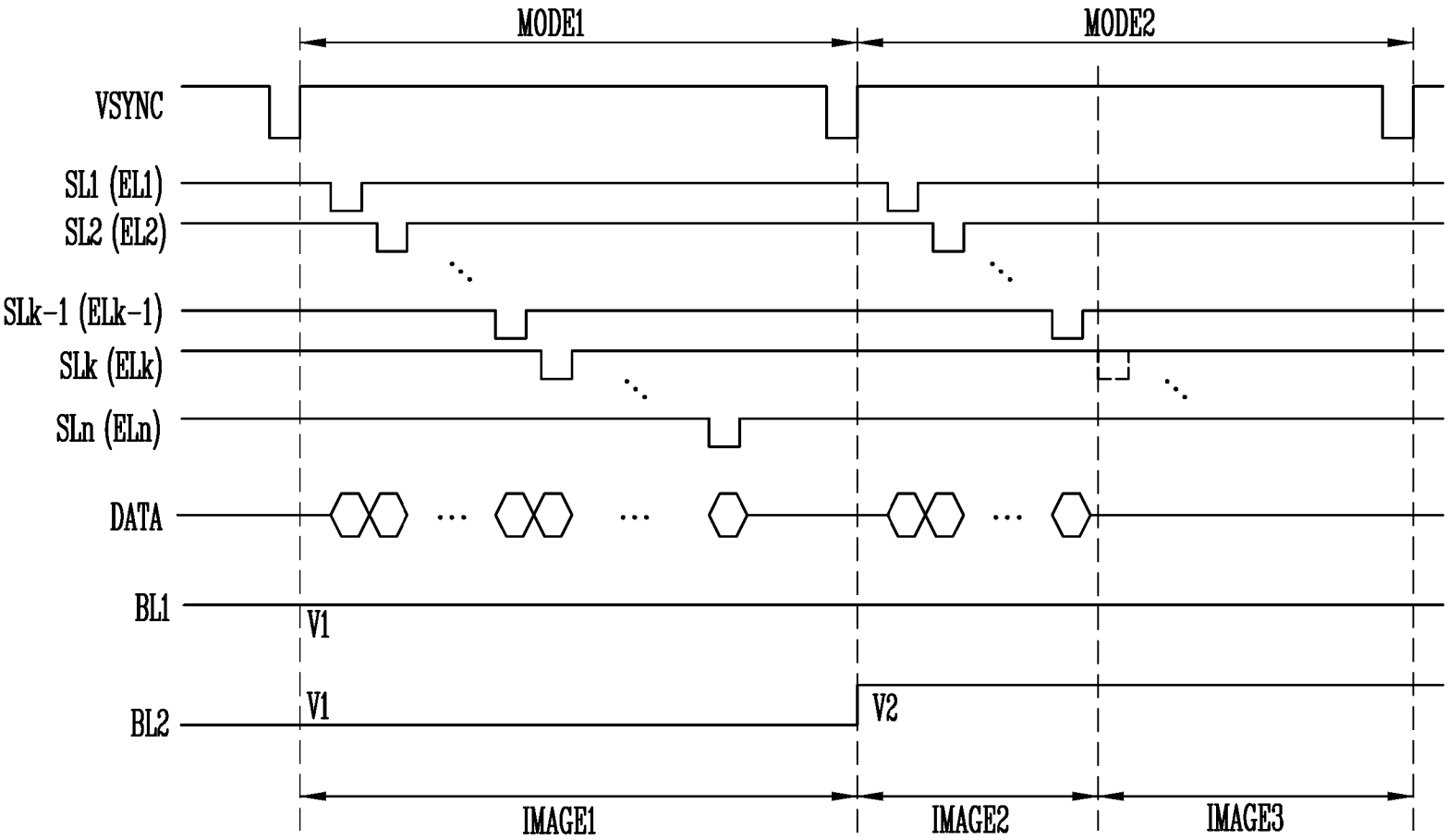
FIG. 7 is a waveform diagram illustrating operation of the display unit of FIG. 6.

FIG. 7 is a waveform diagram illustrating operation of the display unit of FIG. 6.

Referring to FIG. 7, FIG. 7 illustrates a vertical synchronization signal VSYNC, scan signals applied to first to nth scan lines SL1 to SLn (or emission control signals applied to first to nth emission control lines EL1 to ELn), a data signal DATA, and common control voltages applied to the first and second common control lines BL1 and BL2.

The vertical synchronization signal VSYNC may be included in the control signal CS (see FIG. 1) and may define the start of a frame section.

When the display device 100 is operated in a first mode MODE1, scan signals having a low level pulse may be sequentially applied to the first to nth scan lines SL1 to SLn, and a data signal DATA having a valid value (for example, a voltage level corresponding to various gray level values other than a black gray level value) may be applied to data lines. Of course, data signal DATA for some of the pixels may correspond to a black gray level. As the display unit 110_1 (see FIG. 6) (or the first and second active regions AA1 and AA2) normally displays a first image IMAGE1, a common control voltage (for example, a first power voltage VDD) having a first voltage level V1 may be applied to each of the first and second common control lines BL1 and BL2.

When the display device 100 is operated in a second mode MODE2, scan signals having a low level pulse may be sequentially applied to the first to (k−1)th scan lines SL1 to SLk−1 (i.e., to only the first active region AA1), a data signal DATA having a valid value so as to correspond to the first to (k−1)th scan lines SL1 to SLk−1 is applied to the data lines, and a data signal DATA having a reference voltage (i.e., a voltage level corresponding to a black gray level value) so as to correspond to the kth to nth scan lines SLk to SLn may be applied to the data lines. Because only the first active region AA1 displays a second image IMAGE2 and the second active region AA2 displays a third image IMAGE3 (for example, a black image), the common control voltage having the first voltage level V1 may be applied to the first common control line BL1, and a common control voltage having a second voltage level V2 (for example, a gate-off voltage) may be applied to the second common control line BL2.

When the display unit 110_1 (e.g., see FIG. 6) is implemented as a foldable display panel and is folded (i.e., in the second mode MODE2 (e.g., see FIG. 2)), an image may be constantly displayed only in one region of the display unit 110_1 (for example, the first active region AA1 or the second active region AA2). In this case, the display unit 110_1 of FIG. 6 may be applied to the display device 100, and power consumption of the display device 100 (or the data driver 130) may be reduced.

In the present disclosure, while the display unit 110_1 is illustrated in FIG. 6 as including two active regions AA1 and AA2 and two common control lines BL1 and BL2, the present disclosure is not limited thereto. For example, the display unit 110_1 may include three or more active regions and three or more common control lines corresponding thereto.

Figure 8:
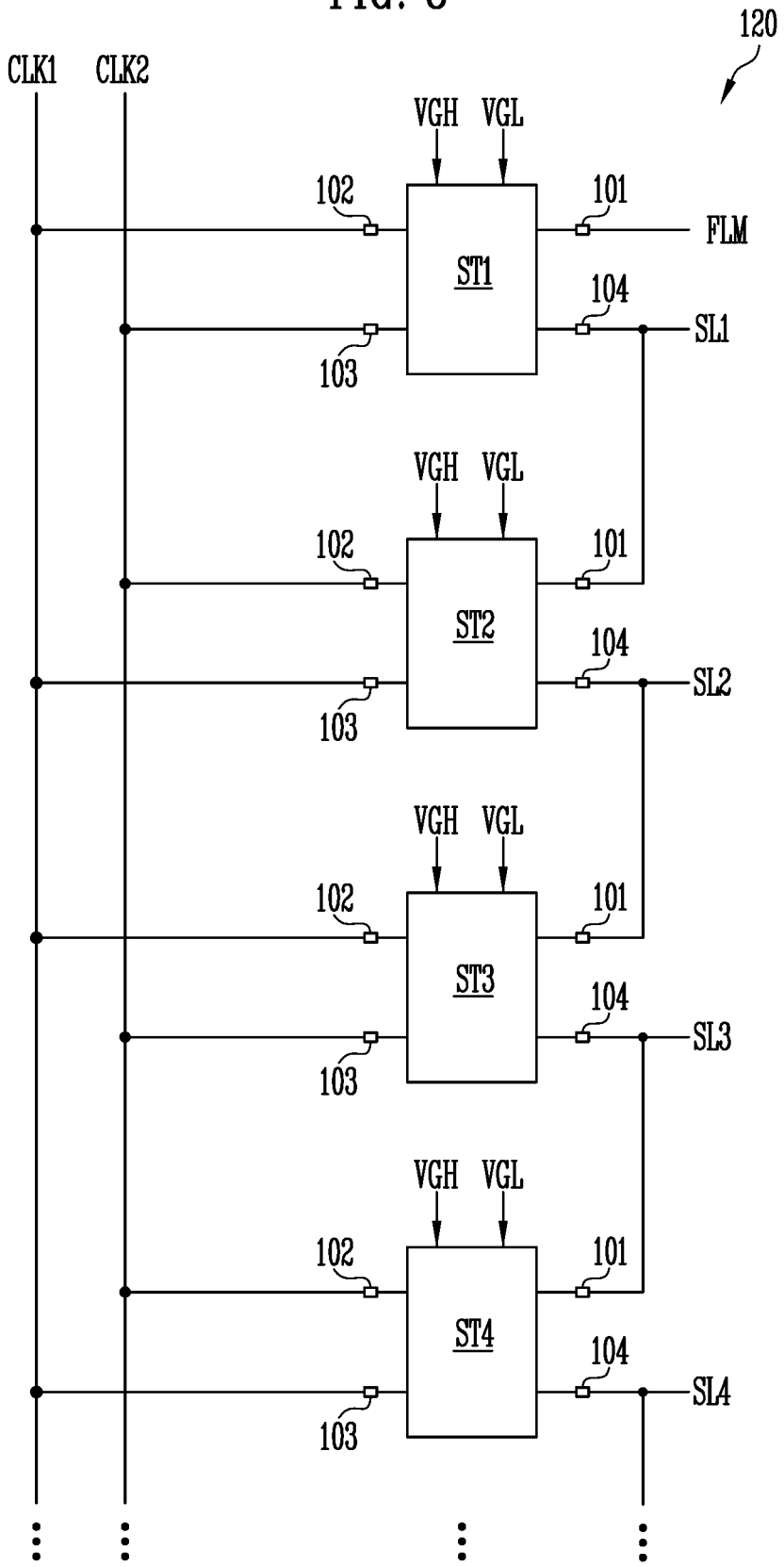
FIG. 8 is a block diagram illustrating an example of a scan driver included in the display device of FIG. 1.

FIG. 8 is a block diagram illustrating an example of a scan driver included in the display device of FIG. 1.

Referring to FIG. 8, a scan driver 120 may include stages ST1 to ST4 (e.g., scan stages or scan stage circuits). The stages ST1 to ST4 may be connected to scan lines SL1 to SL4 respectively corresponding thereto and may be commonly connected to clock signal lines (i.e., signal lines for transmitting clock signals CLK1 and CLK2). The stages ST1 to ST4 each may have substantially the same circuit structure.

Each of the stages ST1 to ST4 may include a first input terminal 101, a second input terminal 102, a third input terminal 103, and an output terminal 104.

The first input terminal 101 may receive a carry signal. Here, the carry signal may include a start signal FLM (or a start pulse) or an output signal (i.e., a scan signal) of a previous stage (or a front stage). For example, the first input terminal 101 of the first stage ST1 may receive the start signal FLM, and the first input terminals 101 of the remaining stages ST2 to ST4 may receive a scan signal outputted by the previous stage. That is, a scan signal outputted by a previous stage of a corresponding stage may be provided to the corresponding stage as a carry signal.

The second input terminal 102 of the first stage ST1 may be connected to a first clock signal line to receive a first clock signal CLK1, and the third input terminal 103 may be connected to a second clock signal line to receive a second clock signal CLK2. The second input terminal 102 of the second stage ST2 may be connected to the second clock signal line to receive the second clock signal CLK2, and the third input terminal 103 thereof may be connected to the first clock signal line to receive the first clock signal CLK1. Similar to the first stage ST1, the second input terminal 102 of the third stage ST3 may be connected to the first clock signal line to receive the first clock signal CLK1, and the third input terminal 103 thereof may be connected to the second clock signal line to receive the second clock signal CLK2. Similar to the second stage ST2, the second input terminal 102 of the fourth stage ST4 may be connected to the second clock signal line to receive the second clock signal CLK2, and the third input terminal 103 thereof may be connected to the first clock signal line to receive the first clock signal CLK1. In other words, the first clock signal line and the second clock signal line may be alternately connected to the second input terminal 102 and the third input terminal 103 of each stage, or the first clock signal CLK1 and the second clock signal CLK2 may be alternately provided to the second input terminal 102 and the third input terminal 103 of each stage.

As will be described below, pulses of the first clock signal CLK1 provided through the first clock signal line and pulses of the second clock signal CLK2 provided through the second clock signal line may not temporally overlap each other. In this case, each of the pulses may have a turn-on voltage level.

The stages ST1 to ST4 may receive a first voltage VGH (or a high voltage level) and a second voltage VGL (or a low voltage level). The first voltage VGH may be set to have a turn-off voltage level, and the second voltage VGL may be set to have a turn-on voltage level.

Figure 9:
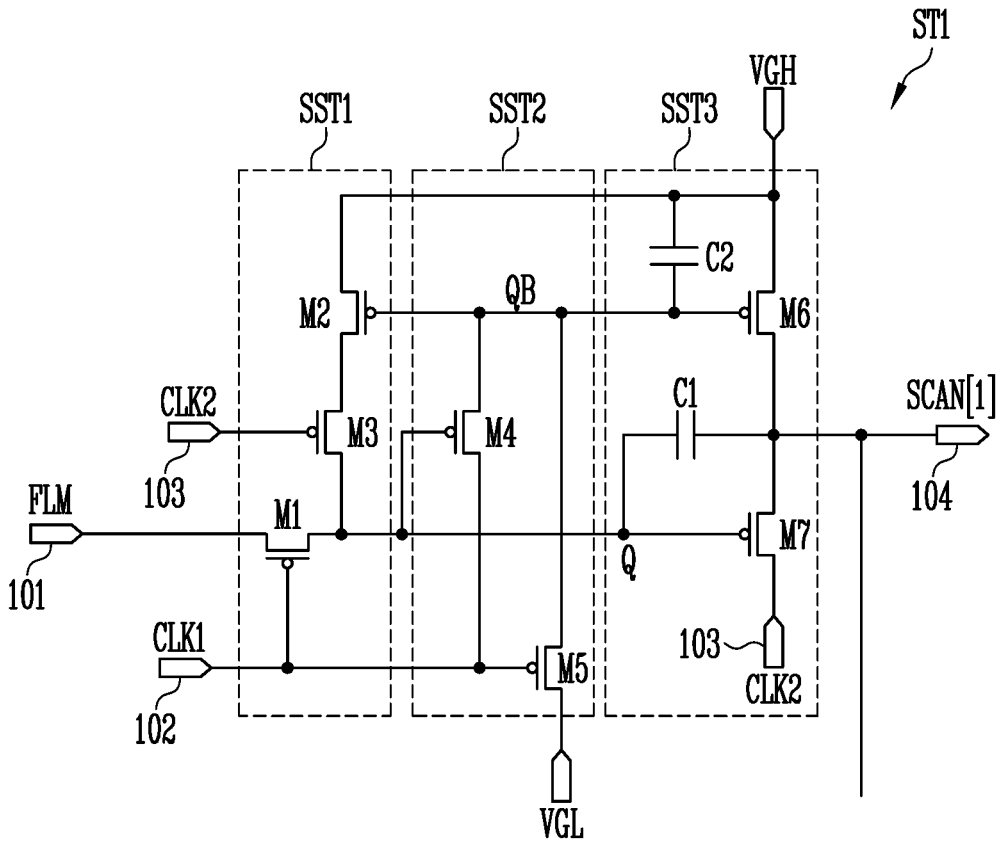
FIG. 9 is a circuit diagram illustrating an example of a first stage included in the scan driver of FIG. 8.

FIG. 9 is a circuit diagram illustrating an example of a first stage included in the scan driver of FIG. 8. Because the stages ST1 to ST4 shown in FIG. 8 are substantially the same except for a configuration for receiving the clock signals CLK1 and CLK2, hereinafter, a first stage ST1 will be primarily described as an example of the stages ST1 to ST4.

Referring to FIGS. 8 and 9, the first stage ST1 may include a first node controller SST1, a second node controller SST2, and a buffer unit (or a buffer) SST3.

The first node controller SST1 may transmit a start signal FLM (or a carry signal) or a first voltage VGH to a first control node Q based on a first clock signal CLK1 and a second clock signal CLK2. The first node controller SST1 may include a first switching element M1, a second switching element M2, and a third switching element M3.

The first switching element M1 may include a first electrode connected to the first input terminal 101 (e.g., the first electrode is configured to receive the start signal FLM (or the carry signal)), a second electrode connected to the first control node Q, and a gate electrode connected to the second input terminal 102 (e.g., the gate electrode is configured to receive the first clock signal CLK1).

The second switching element M2 may include a first electrode configured to receive the first voltage VGH, a second electrode configured to provide the first voltage VGH to the first control node Q (e.g., via the third switching element M3), and a gate electrode configured to receive a signal of a second control node QB.

The third switching element M3 may include a first electrode connected to the second electrode of the second switching element M2, a second electrode connected to the first control node Q, and a gate electrode connected to the third input terminal 103 (e.g., the gate electrode is configured to receive the second clock signal CLK2). Here, the second and third switching elements M2 and M3 may be connected in series with each other between the first voltage VGH and the first control node Q.

The second node controller SST2 may transmit a second voltage VGL that is lower than a first voltage VGH or the first clock signal CLK1 to the second control node QB based on the first clock signal CLK1 and a signal (or a voltage level) of the first control node Q. The second node controller SST2 may include a fourth switching element M4 and a fifth switching element M5.

The fourth switching element M4 may include a first electrode configured to receive the first clock signal CLK1, a second electrode connected to the second control node QB, and a gate electrode configured to receive the signal of the first control node Q.

The fifth switching element M5 may include a first electrode configured to receive the second voltage VGL, a second electrode connected to the second control node QB, and a gate electrode configured to receive the first clock signal CLK1.

The buffer unit SST3 may output a first scan signal SCAN[1] (or a scan signal) including the second clock signal CLK2 as a pulse based on a signal of the first control node Q and a signal of the second control node QB. That is, the buffer unit SST3 may output the second clock signal CLK2 as the first scan signal SCAN[1] (or the scan signal) based on the signal of the first control node Q and the signal of the second control node QB. The first scan signal SCAN[1] may be provided as a carry signal to the second stage ST2 (e.g., see FIG. 8) (or a subsequent stage and/or a rear stage).

The buffer unit SST3 may include a sixth switching element M6 (or a pull-up switching element) and a seventh switching element M7 (or a pull-down switching element). The sixth switching element M6 may include a first electrode configured to receive the first voltage VGH, a second electrode connected to an output terminal 104, and a gate electrode connected to the second control node QB.

The seventh switching element M7 may include a first electrode connected to the output terminal 104, a second electrode configured to receive the second clock signal CLK2, and a gate electrode connected to the first control node Q.

The buffer unit SST3 may further include a first capacitor C1 and a second capacitor C2.

The first capacitor C1 may be connected between the first electrode of the seventh switching element M7 and the gate electrode of the seventh switching element M7 (and the first control node Q).

The second capacitor C2 may be connected between the first electrode of the sixth switching element M6 and the gate electrode of the sixth switching element M6 (and the second control node QB).

The first to seventh switching elements M1 to M7 are illustrated in FIG. 9 as being implemented as p-type transistors, but this is merely an example and the present disclosure is not limited thereto. For example, the first to seventh switching elements M1 to M7 may also be implemented as n-type transistors, and those of ordinary skill in the art would understand that different suitable voltage levels are to be applied thereto when different types of transistors are used.

Figure 10:
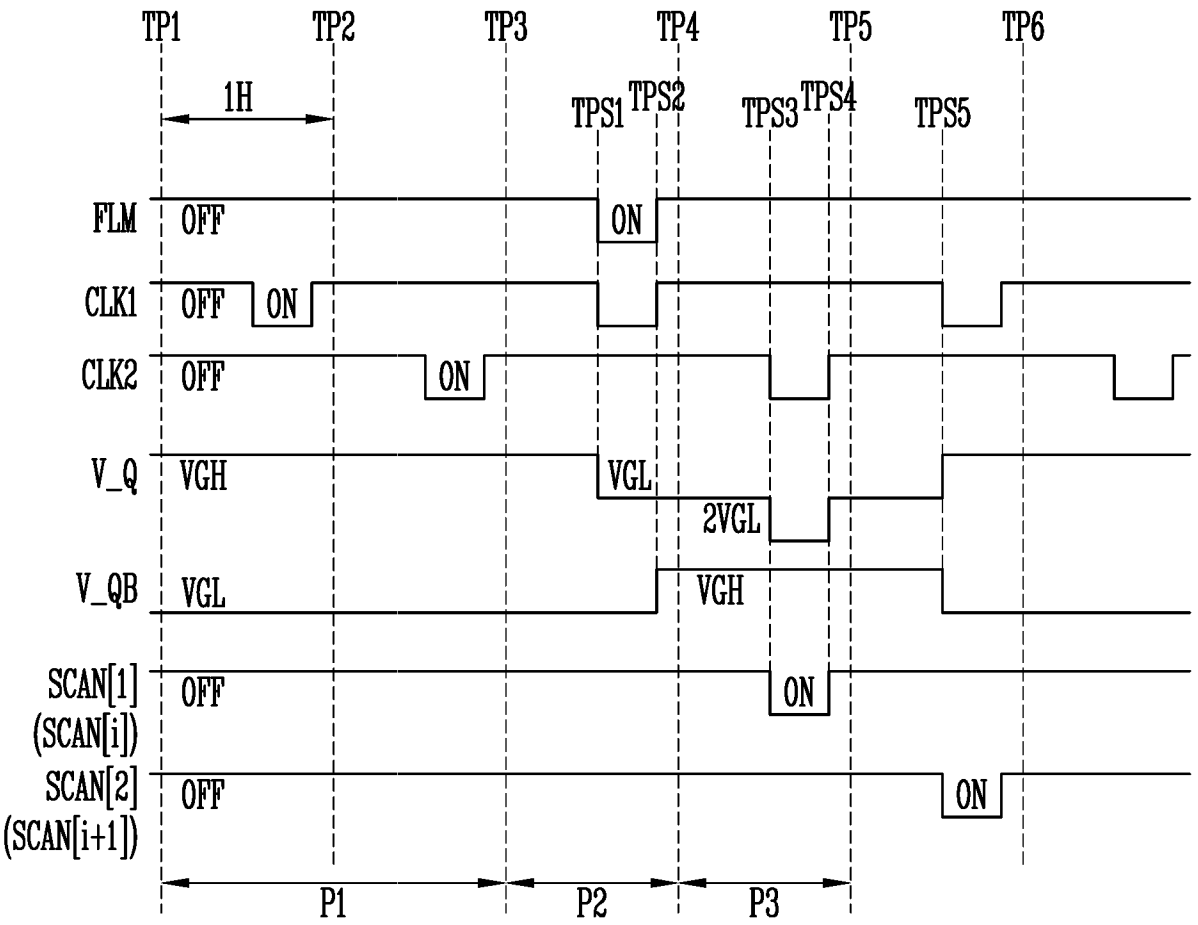
FIG. 10 is a waveform diagram illustrating an example of a signal measured in the first stage of FIG. 9.

FIG. 10 is a waveform diagram illustrating an example of a signal measured in the first stage of FIG. 9. In FIG. 10, first to sixth time points TP1 to TP6 are set as an interval of one horizontal time 1H. In other words, there is an interval of one horizontal time 1H between any two successive time points TP1 through TP6.

Referring to FIGS. 9 and 10, between the first time point TP1 and the second time point TP2, a first clock signal CLK1 may transition from a turn-off voltage level to a turn-on voltage level and then may transition back to the turn-off voltage level. That is, between the first time point TP1 and the second time point TP2, the first clock signal CLK1 may have a pulse with a turn-on voltage level.

Between the second time point TP2 and the third time point TP3, a second clock signal CLK2 may transition from a turn-off voltage level to a turn-on voltage level and then may transition back to the turn-off voltage level. That is, between the second time point TP2 and the third time point TP3, the second clock signal CLK2 may have a pulse with a turn-on voltage level.

The first clock signal CLK1 and the second clock signal CLK2 have the same period (for example, two horizontal times), and a pulse of the second clock signal CLK2 may appear after one horizontal time 1H as compared with a pulse of the first clock signal CLK1. That is, the second clock signal CLK2 may be a signal in which the first clock signal CLK1 is shifted by one horizontal time 1H (or a half period of the first clock signal CLK1).

In a first section P1 between the first time point TP1 and the third time point TP3, a start signal FLM may maintain a turn-off voltage level. That is, the first section P1 may be defined as an initialization section before the start signal FLM having a turn-on voltage level is applied.

In a second section P2 between the third time point TP3 and the fourth time point TP4, the start signal FLM may maintain a turn-on voltage level for at least a portion of the second section P2. For example, at a first sub time point TPS1, the start signal FLM may transition from the turn-off voltage level to the turn-on voltage level, and at a second sub time point TPS2, the start signal FLM may transition from the turn-on voltage level to the turn-off voltage level.

In addition, the first clock signal CLK1 may have a pulse with a turn-on voltage level.

In this case, the first switching element M1 may be turned on in response to the first clock signal CLK1 and may transmit the start signal FLM to the first control node Q. Therefore, the first control node Q may have a turn-on voltage level (e.g., a second voltage VGL) in response to the start signal FLM.

The seventh switching element M7 may be turned on in response to a signal V_Q of the first control node Q and may pull down a first scan signal SCAN[1] (or a scan signal SCAN[i]). The second clock signal CLK2 may be output as the first scan signal SCAN[1].

However, because the second clock signal CLK2 has a turn-off voltage level, the first scan signal SCAN[1] may have a turn-off voltage level.

The first capacitor C1 may store a voltage difference between a turn-off voltage level and a turn-on voltage level based on the signal V_Q of the first control node Q (or a voltage level of the first control node Q) and the first scan signal SCAN[1].

The fifth switching element M5 may be turned on in response to the first clock signal CLK1 and may transmit the second voltage VGL to the second control node QB. Accordingly, the second control node QB may have the second voltage VGL (e.g., a turn-on voltage level).

That is, in the second section P2, the first stage ST1 may prepare an output of the first scan signal SCAN[1] in response to the start signal FLM (or a previous gate signal). The second section P2 may be defined as a preparation section (or a detection section of the start signal FLM) in which the first stage ST1 prepares an output of a scan signal.

In a third section P3 between the fourth time point TP4 and the fifth time point TP5, the second clock signal CLK2 may have a pulse with a turn-on voltage level. For example, at a third sub time point TPS3, the second clock signal CLK2 may transition from a turn-off voltage level to a turn-on voltage level, and at a fourth sub time point TPS4, the second clock signal CLK2 may transition from the turn-on voltage level to the turn-off voltage level.

In this case, because the first control node Q has a turn-on voltage level by the first capacitor C1, the seventh switching element M7 maintains a turn-on state in response to the signal V_Q of the first control node Q. Therefore, the first scan signal SCAN[1] may have a turn-on voltage level according to the second clock signal CLK2. In the present disclosure, the first control node Q may have a voltage level lower than a turn-on voltage level (for example, a second turn-on voltage level 2VGL) by a bootstrap of the first capacitor C1.

The fourth switching element M4 may be turned on in response to the signal V_Q of the first control node Q and may transmit the first clock signal CLK1 to the second control node QB. Therefore, the second control node QB may have a turn-off voltage level (e.g., a first voltage VGH) according to the first clock signal CLK1 having the turn-off voltage level.

In other words, in the third section P3, the first stage ST1 may output the first scan signal SCAN[1] having the turn-on voltage level, and the third section P3 may be defined as an output section.

On the other hand, the second stage ST2 (see FIG. 48) receiving the first scan signal SCAN[1] of the first stage ST1 as a carry signal may prepare output of a second scan signal SCAN[2] (or a scan signal SCAN[i+1]) in response to the first scan signal SCAN[1] having the turn-on voltage level.

Thereafter, between the fifth time point TP5 and the sixth time point TP6, the first clock signal CLK1 may have a pulse with a turn-on voltage level.

At a fifth sub time point TPS5, the first switching element M1 may be turned on in response to the first clock signal CLK1, and the first control node Q may be connected to the first input terminal 101. Because the start signal FLM having a turn-off voltage level is applied to the first input terminal 101 between the fifth time point TP5 and the sixth time point TP6, the first control node Q may transition to a turn-off voltage level (or, the first voltage VGH).

In addition, the fifth switching element M5 may be turned on in response to the first clock signal CLK1, and the second voltage VGL may be transmitted to the second control node QB. The sixth switching element M6 may be turned on in response to a signal V_QB of the second control node QB and may pull up the first scan signal SCAN[1] (or the scan signal SCAN[i]). The first voltage VGH may be output as the first scan signal SCAN[1].

The second stage ST2 (e.g., see FIG. 8) may be operated the same as or similar to the first stage ST1 in the third section P3 and may output the second scan signal SCAN[2] having a turn-on voltage level.

Next, subsequent stages (for example, the third stage ST3 and the fourth stage ST4 described with reference to FIG. 8) may sequentially output scan signals at an interval of one horizontal time 1H.

Figure 11:
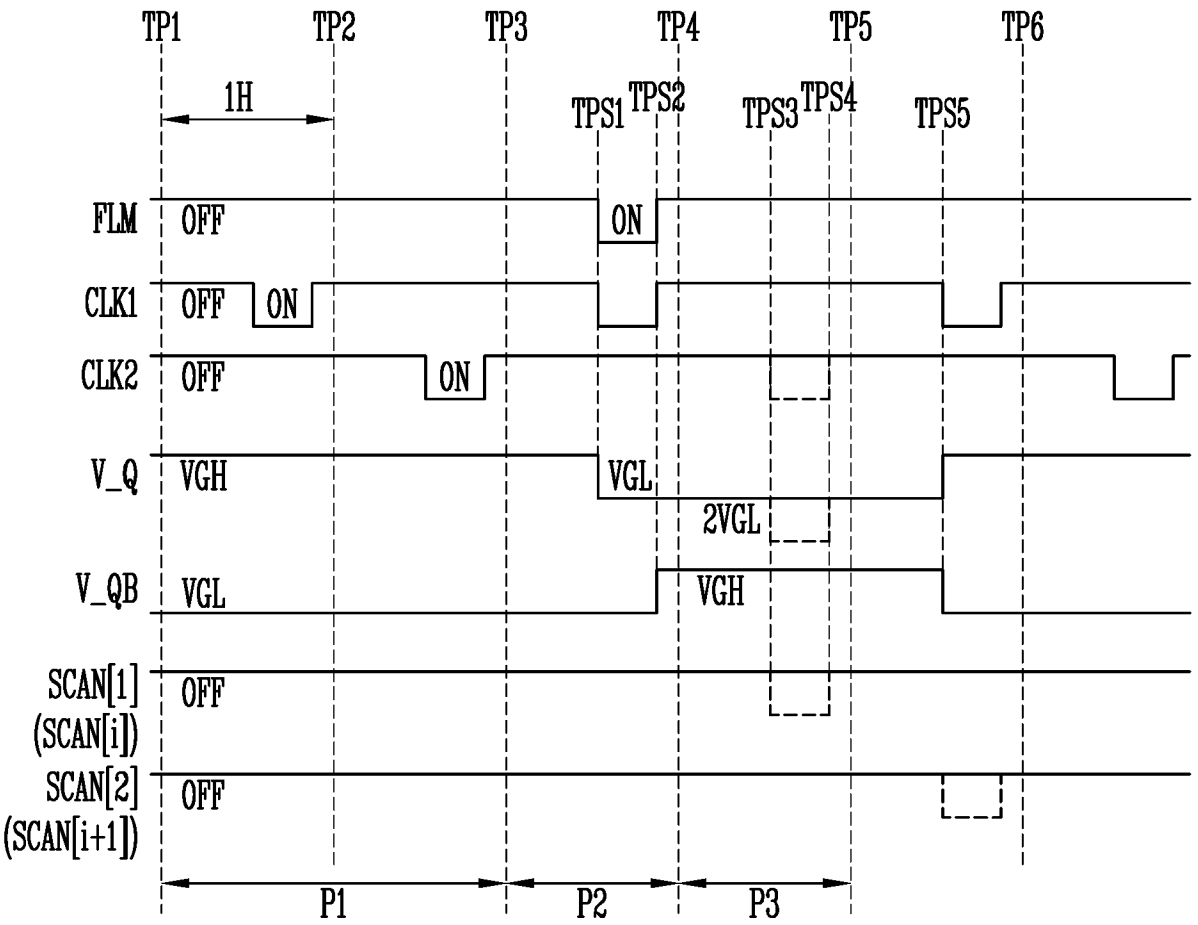
FIG. 11 is a waveform diagram illustrating another example of a signal measured in the first stage of FIG. 9.

FIG. 11 is a waveform diagram illustrating another example of a signal measured in the first stage of FIG. 9. FIG. 11 illustrates the waveform diagram corresponding to the waveform diagram of FIG. 10, and the waveform diagram of FIG. 10 is illustrated in a dotted line form.

Referring to FIGS. 9 to 11, in a section between a third time point TP3 and a fourth time point TP4, a start signal FLM may have a pulse with a turn-on voltage level. In addition, a first clock signal CLK1 may have a pulse with a turn-on voltage level.

In this case, the first switching element M1 may be turned on in response to the first clock signal CLK1 and may transmit the start signal FLM to the first control node Q. Therefore, the first control node Q may have a turn-on voltage level (e.g., a second voltage VGL) in response to the start signal FLM.

The seventh switching element M7 may be turned on in response to a signal V_Q of the first control node Q and may pull down a first scan signal SCAN[1] (or a scan signal SCAN[i]). A second clock signal CLK2 may be output as the first scan signal SCAN[1].

However, because the second clock signal CLK2 has a turn-off voltage level, the first scan signal SCAN[1] may also have a turn-off voltage level.

The first capacitor C1 may store a voltage difference between a turn-off voltage level and a turn-on voltage level based on the signal V_Q of the first control node Q (e.g., a voltage level of the first control node Q) and the first scan signal SCAN[1].

The fifth switching element M5 may be turned on in response to the first clock signal CLK1 and may transmit the second voltage VGL to the second control node QB. Accordingly, the second control node QB may have the second voltage VGL (e.g., a turn-on voltage level).

In other words, in a second section P2, the first stage ST1 may prepare an output of the first scan signal SCAN[1] in response to the start signal FLM (or a previous gate signal).

In a third section P3 between a fourth time point TP4 and a fifth time point TP5, the second clock signal CLK2 may be maintained at a turn-off voltage level instead of having a pulse with a turn-on voltage level.

For example, the timing controller 140 (e.g., see FIG. 1) may mask the second clock signal CLK2 in the third section P3 corresponding to the first stage ST1 (i.e., an output section of the first stage ST1) to output the second clock signal CLK2 having a turn-off voltage level or block output of the second clock signal CLK2.

In this case, because the first control node Q has a turn-on voltage level by the first capacitor C1, the seventh switching element M7 maintains a turn-on state in response to the signal V_Q of the first control node Q. Therefore, the first scan signal SCAN[1] may be maintained at a turn-off voltage level according to the second clock signal CLK2.

Thereafter, between the fifth time point TP5 and a sixth time point TP6, the first clock signal CLK1 may have a pulse with a turn-on voltage level.

In this case, the first switching element M1 may be turned on in response to the first clock signal CLK1, and the first control node Q may be connected to the first input terminal 101. Because the start signal FLM having a turn-off voltage level is applied to the first input terminal 101 between the fifth time point TP5 and the sixth time point TP6, the first control node Q may transition to a turn-off voltage level (e.g., the first voltage VGH).

For reference, when the first clock signal CLK1 has a turn-off voltage level between the fifth time point TP5 and the sixth time point TP6, the signal V_Q of the first control node Q may be maintained at a turn-on voltage level (e.g., the second voltage VGL). In this case, in a subsequent section (for example, after the sixth time point TP6), the second clock signal CLK2 having a turn-on voltage level may be output as the first scan signal SCAN[1]. Therefore, when the second clock signal CLK2 is masked in the third section P3, the first clock signal CLK1 may have a pulse with a turn-on voltage level in a section immediately subsequent to the third section P3 (i.e., a section between the fifth time point TP5 and the sixth time point TP6).

On the other hand, because the first scan signal SCAN[1] provided as a carry signal to the second stage ST2 (see FIG. 48) at the fourth time point TP4 and the fifth time point TP5 has a turn-off voltage level, a second scan signal SCAN[2] (or a scan signal SCAN[i+1]) may have a turn-off voltage level at the fifth time point TP5 and the sixth time point TP6.

In other words, the display device 100 (see FIG. 1) (or the timing controller 140) may mask one of the clock signals CLK1 and CLK2 and thus may mask output of a stage corresponding to the masked clock signal (for example, output (scan signal or carry signal) of the first stage ST1).

Accordingly, the scan driver 120 may not output a scan signal during one frame section and may also selectively provide a scan signal only in a specific section within one frame section, i.e., to only some of the scan lines SL1 to SLn. Therefore, some pixels may be selectively driven. For example, instead of masking the second clock signal CLK2 in the third section P3, when the first clock signal CLK1 is masked in a section between the fifth time point TP5 and the sixth time point TP6, the first scan signal SCAN[1] may have a turn-on voltage level, and the second scan signal SCAN[2] may have a turn-off voltage level. In other words, only the first scan line SL1 (see FIG. 1) to which the first scan signal SCAN[1] is applied may be selected.

Figure 12:
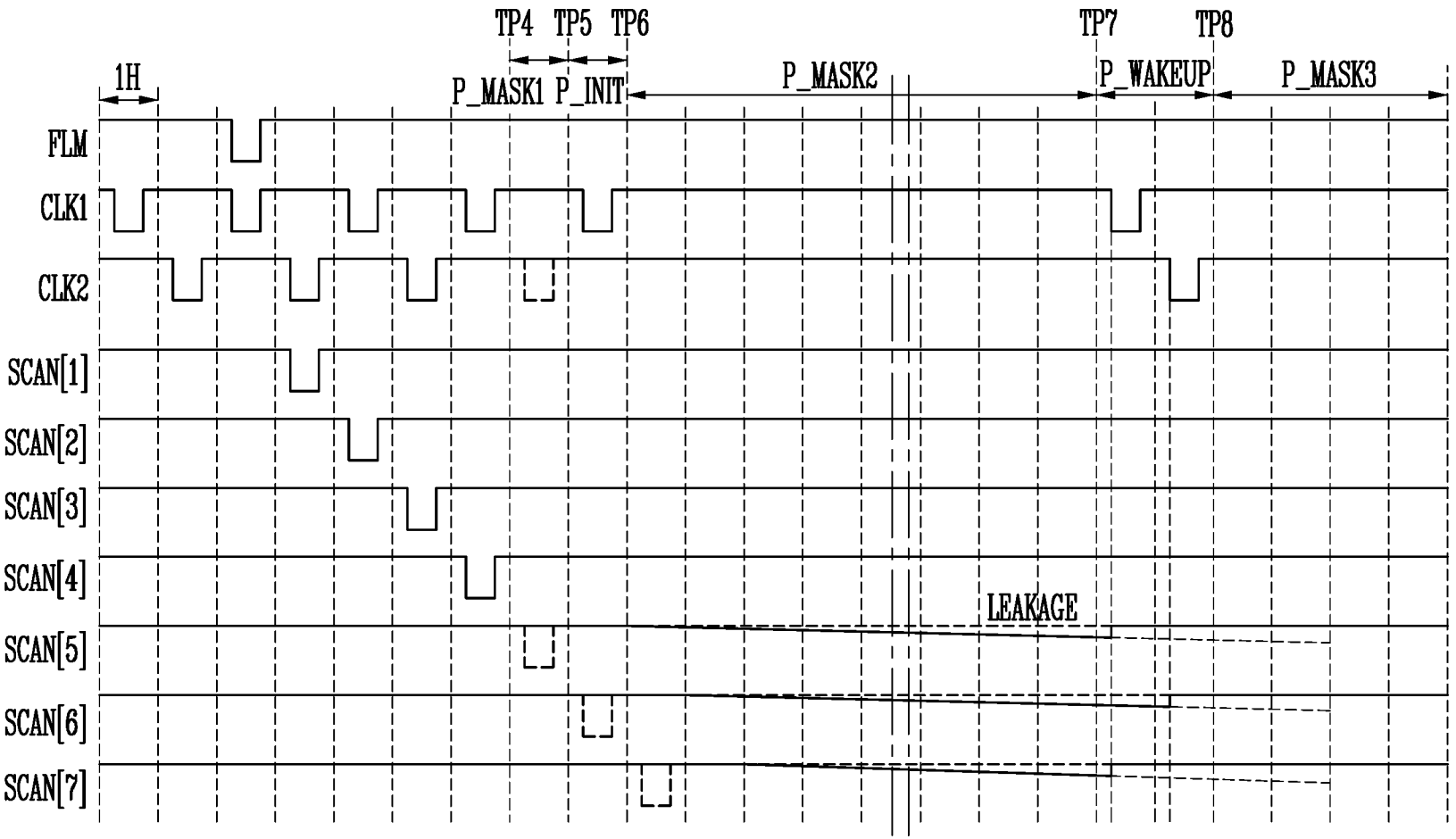
FIG. 12 is a waveform diagram illustrating operation of the scan driver of FIG. 8.

FIG. 12 is a waveform diagram illustrating operation of the scan driver of FIG. 8 according to an example embodiment.

First, referring to FIGS. 10 to 12, a start signal FLM and first and second clock signals CLK1 and CLK2 shown show in FIG. 12 may be substantially the same as or similar to the start signal FLM and the first and second clock signals CLK1 and CLK2 shown in FIG. 11, respectively. In addition, a first scan signal SCAN[1] and a second scan signal SCAN[2] show in FIG. 12 may be substantially the same as or similar to the first scan signal SCAN[1] and the second scan signal SCAN[2] shown in FIG. 10, respectively. Therefore, redundant descriptions may be omitted.

On the other hand, a third scan signal SCAN[3] may have a waveform in which the second scan signal SCAN[2] is shifted by a half period according to the first and second clock signals CLK1 and CLK2 having pulses with a turn-off voltage level. Similarly, a fourth scan signal SCAN[4] may have a waveform in which third scan signal SCAN[3] is shifted by a half period.

In example embodiments, at least some of the clock signals CLK1 and CLK2 may be masked in first, second, and third sections included in one frame section. That is, the timing controller 140 (see FIG. 1) may mask the clock signals CLK1 and CLK2 three times during a frame section.

In a first masking section P_MASK1 between a fourth time point TP4 and a fifth time point TP5, the second clock signal CLK2 may be masked and may have a turn-off voltage level instead of a pulse with a turn-on voltage level.

In this case, the fifth stage may be operated substantially the same as the first stage ST1 (e.g., see FIG. 8) between the fourth time point TP4 and the fifth time point TP5 described with reference to FIG. 11 and may output a fifth scan signal SCAN[5] having a turn-off voltage level instead of a pulse with a turn-on voltage level.

As described with reference to FIG. 11, a width of the first masking section P_MASK1 may be less than or equal to a period of the first and second clock signals CLK1 and CLK2, and for example, may be one horizontal time 1H. In addition, the first masking section P_MASK1 may correspond to one scan line (for example, a fifth scan line for transmitting the fifth scan signal SCAN[5]).

Next, in an initialization section P_INT between the fifth time point TP5 and a sixth time point TP6, the first clock signal CLK1 may have a pulse with a turn-on voltage level. A first control node Q and a second control node QB of the fifth stage may be initialized substantially the same as the first stage ST1 (e.g., see FIG. 8) between the fifth time point TP5 and the sixth time point TP6 described with reference to FIG. 11.

The initialization section P_INIT is illustrated in FIG. 12 as being a half period of the first and second clock signals CLK1 and CLK2 (for example, one horizontal time 1H), but the present disclosure is not limited thereto. In other embodiments, the initialization section P_INIT may be greater than a second horizontal time or two horizontal times.

In a second masking section P_MASK2 between the sixth time point TP6 and a seventh time point TP7, each of the first and second clock signals CLK1 and CLK2 may be masked, and a voltage level of each of the first and second clock signals CLK1 and CLK2 may be maintained at a turn-off voltage level.

Scan signals (for example, a sixth scan signal SCAN[6] and a seventh scan signal SCAN[7]) subsequent to the fifth scan signal SCAN[5] may not have a pulse with a turn-on voltage level but may have only a turn-off voltage level during a frame section by the fifth scan signal SCAN[5] being skipped.

Therefore, after the sixth time point TP6, the first and second clock signals CLK1 and CLK2 may be maintained at a turn-off voltage level, and thus, a toggling operation of stages subsequent to a seventh stage may be stopped. Thus, power consumption of the scan driver 120 may be reduced.

However, as time elapses from the sixth time point TP6, a voltage level of skipped scan signals (for example, the fifth, sixth, and seventh scan signals SCAN[5], SCAN[6], and SCAN[7]) may be changed. This is because a leakage current occurs through the seventh transistor M7 (see FIG. 9) or the like connected to the output terminal 104 (see FIG. 9) of a corresponding stage.

Accordingly, the display device 100 (and the timing controller 140) according to example embodiments of the present disclosure may perform a control such that each of the first and second clock signals CLK1 and CLK2 has at least one pulse (i.e., a pulse with a turn-on voltage level) in a wake-up section P_WAKEUP (or a reset section) between the seventh time point TP7 and an eighth time point TP8.

Referring to FIGS. 8 and 9, for example, when the first clock signal CLK1 has a pulse with a turn-on voltage level, the fifth switching element M5 of odd-numbered stages ST1 and ST3 from among the stages ST1 to ST4 may be turned on. The second voltage VGL may be applied to the second control node QB of the odd-numbered stages ST1 and ST3. Therefore, a voltage level of scan signals (for example, the fifth scan signal SCAN[5] and the seventh scan signal SCAN[7]) output from the odd-numbered stages ST1 and ST3 may be maintained at a turn-off voltage level again. In the present disclosure, the third switching element M3 of the even-numbered stages ST2 and ST4 from among the stages ST1 to ST4 may be turned on, and the first voltage VGH may be applied to the first control node Q through the second switching element M2 and the third switching element M3 which are in a turn-on state. After that, when the second clock signal CLK2 has a pulse with a turn-on voltage level, the first control node Q of the odd-numbered stages ST1 and ST3 from among the stages ST1 to ST4 may be reset. The second control node QB of the even-numbered stages ST2 and ST4 from among the stages ST1 to ST4 may be reset. Therefore, a voltage level of a scan signal (for example, the sixth scan signal SCAN[6]) output from the even-numbered stages ST2 and ST4 may be maintained at a turn-off voltage level again.

Referring again to FIG. 12, an interval between the seventh time point TP7 and the sixth time point TP6, i.e., a width of the second masking section P_MASK2 may be preset by measuring and analyzing changes in skipped scan signals (for example, the fifth to seventh scan signals SCAN[5] to SCAN[7]).

In a third masking section P_MASK3 subsequent to the eighth time point TP8, each of the first and second clock signals CLK1 and CLK2 may be masked, and a voltage level of each of the first and second clock signals CLK1 and CLK2 may be maintained at a turn-off voltage level. Therefore, toggling operations of the stages may be stopped, and power consumption of the scan driver 120 may be reduced.

As described with reference to FIG. 12, power consumption of the scan driver 120 may be reduced by masking the clock signals CLK1 and CLK2. The clock signals CLK1 and CLK2 may have a pulse with a turn-on level voltage at a specific time point after a specific time has passed, and thus, a change in scan signal may be compensated for.

In the present disclosure, while only voltage levels of the fifth to seventh scan signals SCAN[5] to SCAN[7] are illustrated in FIG. 12 as being changed, the present disclosure is not limited thereto. For example, in the case of low frequency driving, voltage levels of all scan signals may be changed.

Figure 13:
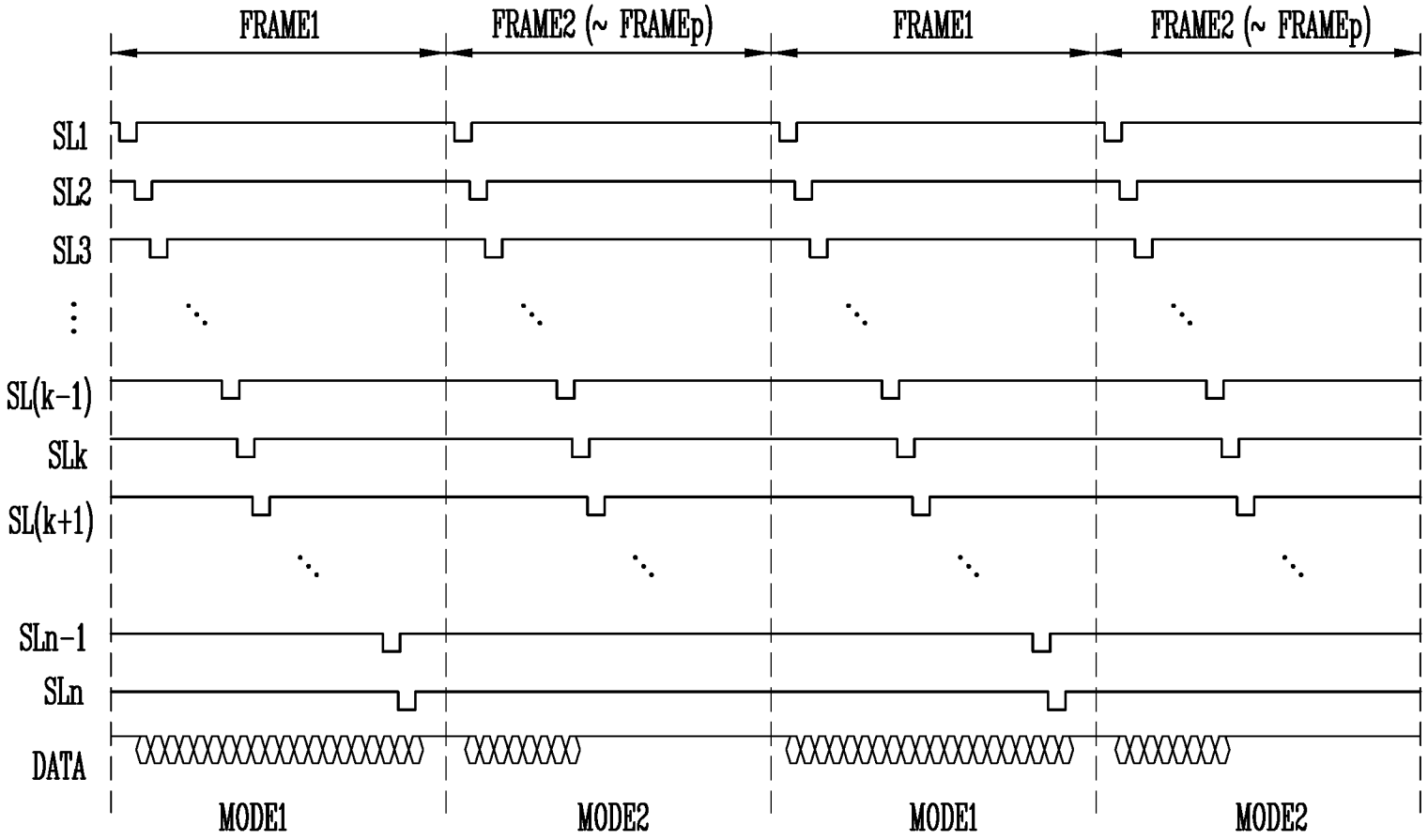
FIG. 13 is a waveform diagram illustrating operation of the display device of FIG. 1.

FIG. 13 is a waveform diagram illustrating operation of the display device of FIG. 1 according to an example embodiment of the present disclosure.

Referring to FIGS. 1 and 13, in the entirety of a first frame section FRAME1 (or a first frame), data signals may have a valid value.

In this case, in the first frame section FRAME1, the timing controller 140 may be operated in a first mode MODE1 and may generate scan clock signals without a masking operation. Accordingly, scan signals having a pulse with a turn-on voltage level may be sequentially applied to first to nth scan lines SL1 to SLn.

In some sections of a second frame section FRAME2 (or a second frame), data signals may have valid values, and in the remaining sections of the second frame section FRAME2, data signals may have an invalid value.

In this case, in the second frame section FRAME2, the timing controller 140 may be operated in a second mode MODE2, and may determine masking time points of scan clock signals, and may partially mask the scan clock signals at a specific time point (or a specific section) of the second frame section FRAME2. Accordingly, scan signals having a pulse with a turn-on voltage level may be sequentially applied to the first to (k−1)th scan lines SL1 to SLk−1, and scan signals having only a turn-off voltage level (i.e., the form of a DC) may be applied to the kth to $n^{th}$ scan lines SLk to SLn.

When the first frame section FRAME1 and the second frame section FRAME2 are alternately repeated, an image may be displayed in the second display region DA2 (see FIG. 2) corresponding to the kth to nth scan lines SLk to SLn, wherein the image has a driving frequency of 60 Hz which is half of a driving frequency of 120 Hz of the first display region DA1 (see FIG. 2) corresponding to the first to (k−1)th scan lines SL1 to SLk−1.

When the timing controller 140 is operated in the second mode MODE2 during second to pth frame sections FRAME2 to FRAMEp, an image having a lower frequency may be displayed in the second display region DA2 (see FIG. 2). For example, when p is 120, an image having a frequency of 1 Hz may be displayed in the second display region DA2 (see FIG. 2).

In the present disclosure, in order to further reduce power consumption, the display device 100 may commonly generate and output a data signal with respect to the second display region DA2 (see FIG. 2) while being operated in the second mode MODE2.

Figure 14:
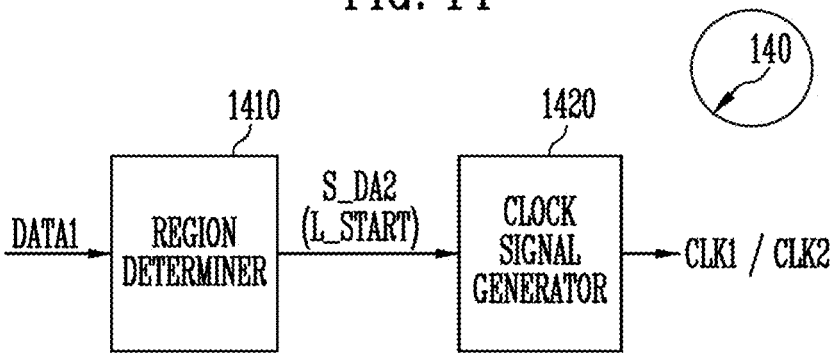
FIG. 14 is a block diagram illustrating an example of a timing controller included in the display device of FIG. 1.

FIG. 14 is a block diagram illustrating an example of a timing controller included in the display device of FIG. 1 according to an example embodiment of the present disclosure.

Referring to FIGS. 1, 2, and 14, the timing controller 140 may include a region determiner 1410 and a clock signal generator 1420. Each of the region determiner 1410 and the clock signal generator 1420 may be implemented as a logic circuit.

The region determiner 1410 may compare current frame data with previous frame data included in input image data DATA1 and may determine a second display region DA2 in which a still image or black image is displayed. For example, the region determiner 1410 may perform subtraction on the current frame data and the previous frame data and may determine a region, in which a subtraction result is less than or equal to a reference value, as the second display region DA2. The region determiner 1410 may generate information S_DA2 about the second display region DA2 or information L_START about a start line of the second display region DA2 (for example, information about a kth scan line SLk).

The clock signal generator 1420 may generate clock signals CLK1 and CLK2 and may mask at least one pulse of the clock signals CLK1 and CLK2 based on the information S_DA2 about the second display region DA2 (or the information L_START about the start line). Referring to FIG. 12, for example, the clock signal generator 1420 may mask the second clock signal CLK2 in a first masking section P_MASK1. In addition, the clock signal generator 1420 may mask the first and second clock signals CLK1 and CLK2 in a second masking section P_MASK2 spaced from the first masking section P_MASK1.

As described with reference to FIG. 14, the timing controller 140 may adjust only a time point at which at least one of the clock signals CLK1 and CLK2 is masked, thereby selectively driving only some of the scan lines SL1 to SLn and some pixels corresponding thereto.

Figure 15:
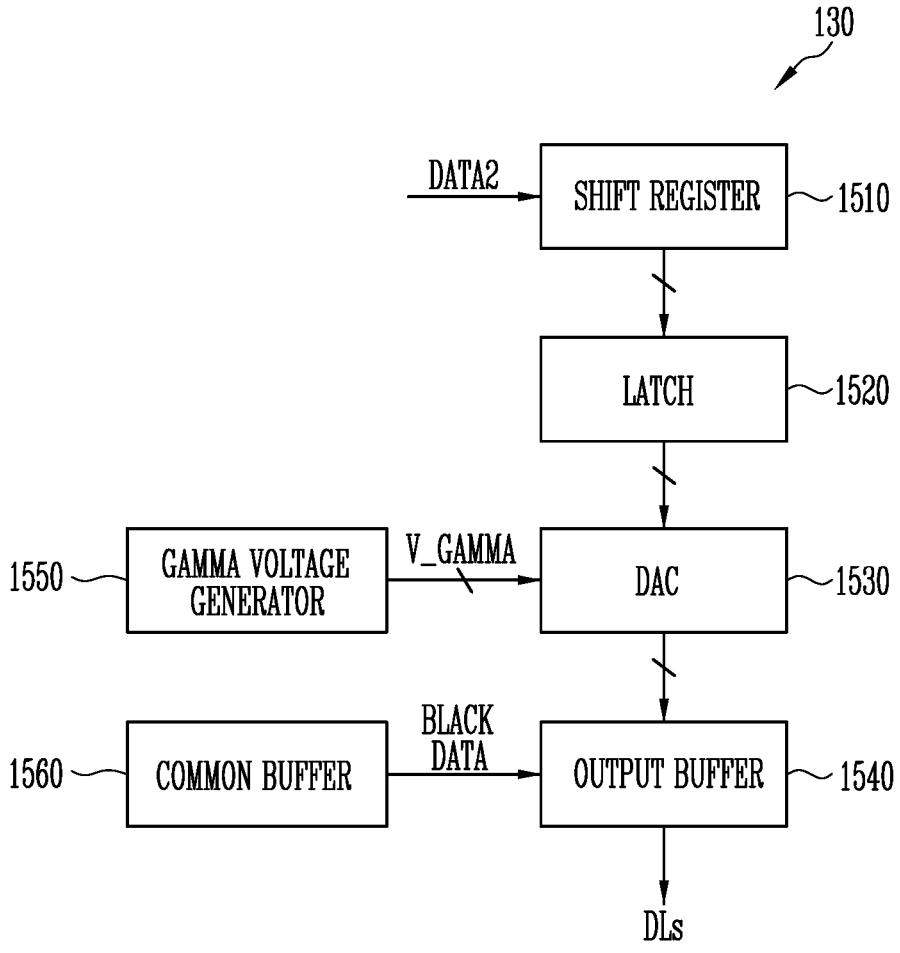
FIG. 15 is a block diagram illustrating an example of a data driver included in the display device of FIG. 1.

FIG. 15 is a block diagram illustrating an example of a data driver included in the display device of FIG. 1 according to an example embodiment of the present disclosure.

Referring to FIG. 15, the data driver 130 may include a shift register 1510, a latch 1520, a decoder 1530 (or a digital-analog converter (DAC)), an output buffer 1540, a gamma voltage generator 1550, and a common buffer (e.g., a partial buffer) 1560.

The shift register 1510 may provide image data DATA2 received from the timing controller 140 in a parallelized form to the latch 1520. In other words, the shift register 1510 may convert the image data (provided serially) to parallel data pieces, and provide to the latch 1520. The shift register 1510 may generate and provide a latch clock signal to the latch 1520, and the latch clock signal may be used to control a timing at which parallelized data is output.

The latch 1520 may latch or temporarily store pieces of data sequentially received from the shift register 1510 and transmit the received pieces of data to the decoder 1530.

The decoder 1530 may convert digital data (i.e., a gray level value of parallelized data) into an analog data signal (or data voltages) using gamma voltages V_GAMMA.

The output buffer 1540 may receive data signals and output the data signals to data lines DLs (i.e., the data lines DL1 to DLm of the display unit 110 described with reference to FIG. 1). The output buffer 1540 may include source buffers connected to the data lines DLs.

The output buffer 1540 may alternately or selectively output a data signal and a common voltage provided from the common buffer 1560 in a second mode.

The gamma voltage generator 1550 may generate gamma voltages GAMMA having various voltage levels.

The gamma voltage generator 1550 may include gamma buffers which transmit representative gamma voltages to a resistor string and taps of the resistor string. The gamma voltage generator 1550 may be a digital gamma voltage generator. In this case, gamma voltages V_GAMMA output from the gamma voltage generator 1550 may be linear or substantially linear.

The common buffer 1560 may output one gamma voltage provided from the gamma voltage generator 1550 as a common voltage (for example, a data voltage BLACK DATA corresponding to a black gray level).

A configuration of the output buffer 1540 according to an example embodiment of the present disclosure will be described with reference to FIG. 16.

Figure 16:
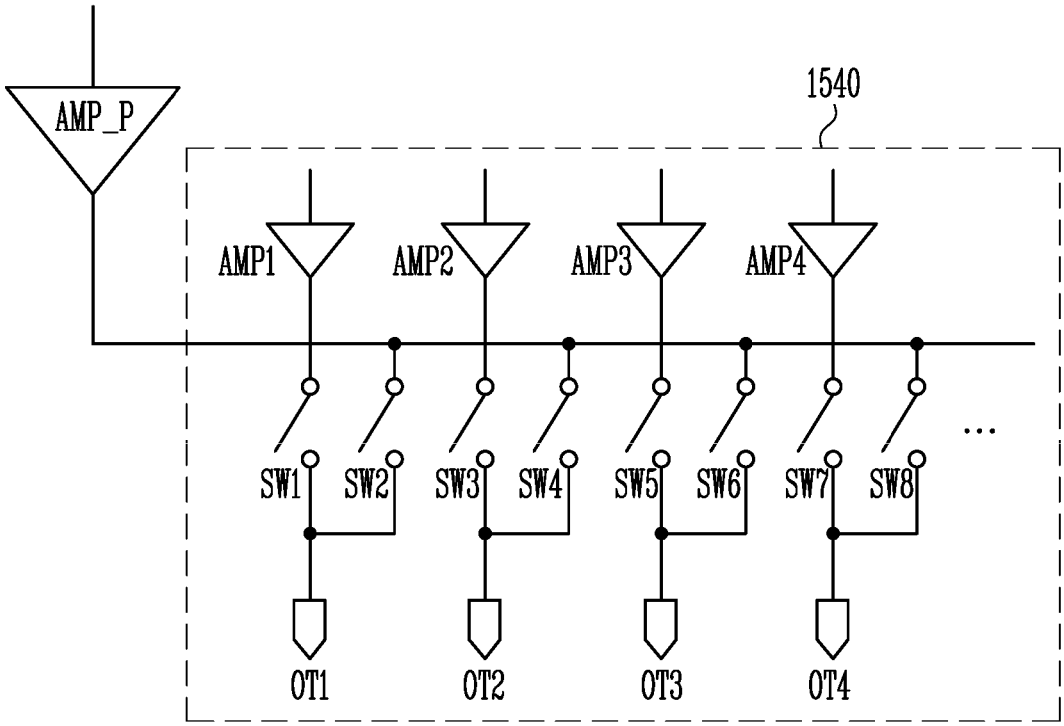
FIG. 16 is a circuit diagram illustrating an example of an output buffer included in the data driver of FIG. 15.
Figure 17:
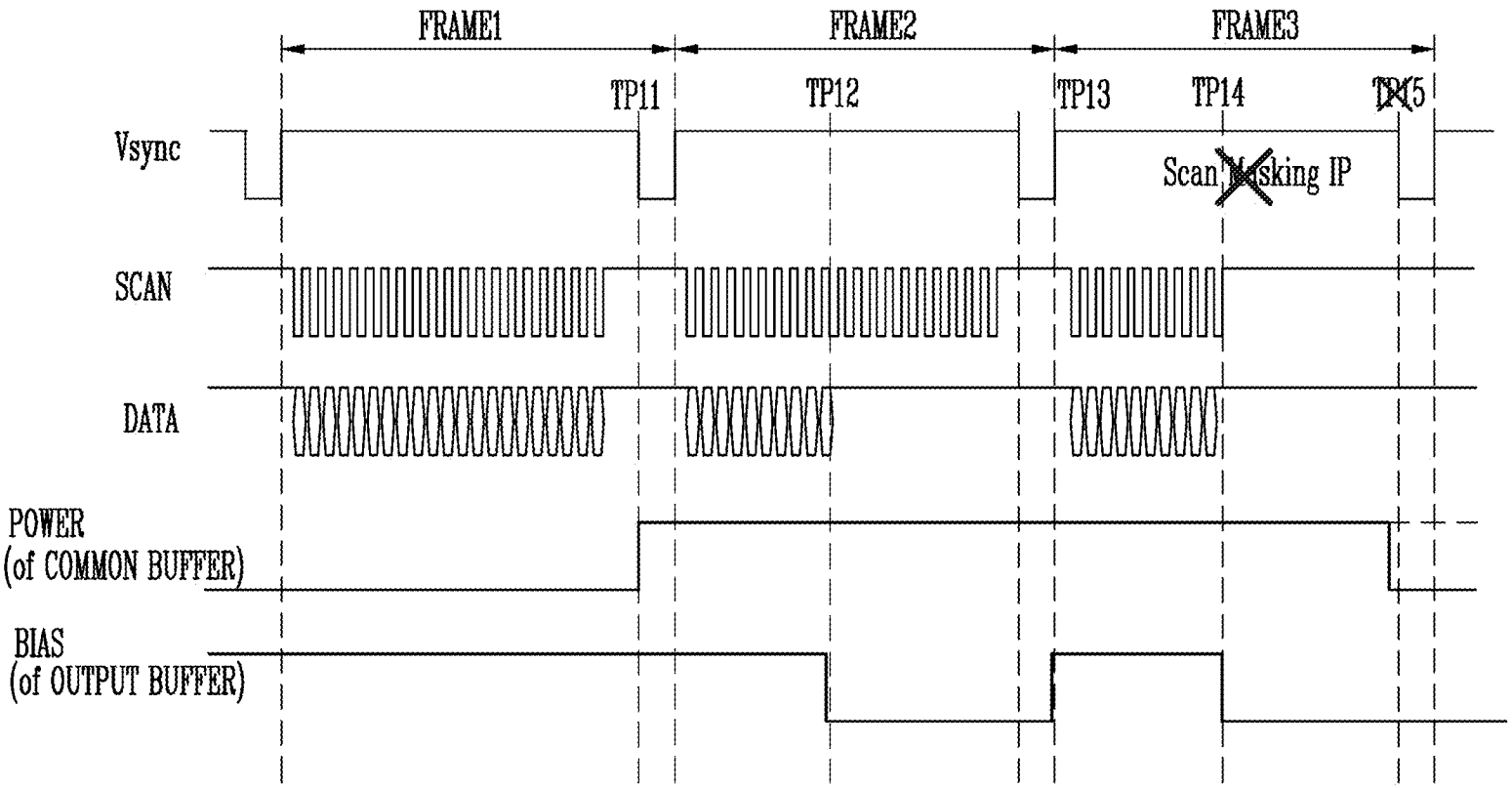
FIG. 17 is a waveform diagram illustrating operation of the data driver of FIG. 15.

FIG. 16 is a circuit diagram illustrating an example of an output buffer 1540 included in the data driver of FIG. 15. FIG. 17 is a waveform diagram illustrating operation of the data driver of FIG. 15 according to an example embodiment of the present disclosure.

First, referring to FIG. 16, the output buffer 1540 may include source buffers AMP1, AMP2, AMP3, and AMP4 and switches SW1 to SW8. A power amplifier AMP_P may represent an example of the common buffer (e.g., the partial buffer) 1560 shown in FIG. 15.

A first source buffer AMP1 may be connected to a first output terminal OT1 through a first switch SW1. For example, the first output terminal OT1 may be connected to the first data line DL1 (see FIG. 1).

A second switch SW2 may be connected between an output terminal of the power amplifier AMP_P and the first output terminal OT1.

Similarly, a second source buffer AMP2 may be connected to a second output terminal OT2 through a third switch SW3. For example, the second output terminal OT2 may be connected to the second data line DL2 (see FIG. 1).

A fourth switch SW4 may be connected between the output terminal of the power amplifier AMP_P and the second output terminal OT2.

A third source buffer AMP3 may be connected to a third output terminal OT3 through a fifth switch SW5, and a sixth switch SW6 may be connected between the output terminal of the power amplifier AMP_P and the third output terminal OT3. A fourth source buffer AMP4 may be connected to a fourth output terminal OT4 through a seventh switch SW7, and an eighth switch SW8 may be connected between the output terminal of the power amplifier AMP_P and the fourth output terminal OT4.

Referring to FIGS. 16 and 17, a vertical synchronization signal Vsync may have a low level periodically, and a start time of each of frame sections FRAME1, FRAME2, and FRAME3 may be defined by the vertical synchronization signal Vsync. In other words, the start time of each frame section may be synchronized with the vertical synchronization signal Vsync.

In the entirety of a first frame section FRAME1 as shown in FIG. 17, a data signal DATA has a valid value. Accordingly, the display device 100 may be operated in a first mode in the first frame section FRAME1.

The output buffer 1540 (or the source buffers AMP1, AMP2, AMP3, and AMP4) outputting the data signal DATA may be normally operated, and a bias BIAS (or a bias current) applied to the output buffer 1540 may have a high level.

The first, third, fifth, and seventh switches SW1, SW3, SW5, and SW7 in the output buffer 1540 may be turned on, and data signals may be output to data lines through the source buffers AMP1 to AMP4 and the output terminals OT1 to OT4.

In the present disclosure, because the common buffer 1560 does not supply a separate voltage to the output buffer 1540 in the described embodiment, output POWER of the common buffer 1560 may have a low level.

A scan signal SCAN has pulses with a turn-on voltage level (e.g., a low level) in the entirety of the first frame section FRAME1 in response to the data signal DATA, and an image may be displayed in an entire region of the display unit 110 (see FIG. 1).

The data signal DATA may have a valid value in some sections of a second frame section FRAME2. However, the display device 100 may be operated in the first mode. Referring to FIG. 14, for example, the timing controller 140 may compare current frame data with previous frame data to determine a region in which a still image or a black image is displayed. The timing controller 140 may determine that an image in the second frame section FRAME2 is changed as compared with the first frame section FRAME1.

The output buffer 1540 (or the source buffers AMP1, AMP2, AMP3, and AMP4) outputting the data signal DATA may be operated only in some sections of the second frame section FRAME2. To this end, the bias BIAS (or the bias current) applied to the output buffer 1540 and the output POWER of the common buffer 1560 may have a high level. For example, the output POWER of the common buffer 1560 may transition to a high level at an eleventh time point TP11 at which the reception of data to be used in the second frame section FRAME2 is completed.

The first, third, fifth, and seventh switches SW1, SW3, SW5, and SW7 in the output buffer 1540 may be turned on, and data signals may be output to the data lines through the source buffers AMP1 to AMP4 and the output terminals OT1 to OT4.

Thereafter, at a twelfth time point TP12, i.e., at a time point at which the data signal DATA has a common voltage (for example, a data voltage corresponding to a black gray level), the bias BIAS applied to the output buffer 1540 may transition to a low level.

Next, the second, fourth, sixth, and eighth switches SW2, SW4, SW6, and SW8 in the output buffer 1540 may be turned on, and a common voltage may be output through one power amplifier AMP_P. In this case, power consumption according to operations of the source buffers AMP1 to AMP4 may be reduced.

As the display device 100 is operated in the first mode, the scan signal SCAN may have pulses with a turn-on voltage level (or a low level) in the entirety of the second frame section FRAME2.

The data signal DATA may have a valid value in some sections of a third frame section FRAME3. In this case, the display device 100 may be operated in a second mode. Referring to FIG. 14, for example, the timing controller 140 may compare current frame data with previous frame data to determine a region in which a still image or black image is displayed.

The output buffer 1540 (or the source buffers AMP1, AMP2, AMP3, and AMP4) outputting the data signal DATA may be operated only in some sections of the third frame section FRAME3. To this end, the bias BIAS (or the bias current) applied to the output buffer 1540 may transition to a high level again at a thirteenth time point TP13.

The first, third, fifth, and seventh switches SW1, SW3, SW5, and SW7 in the output buffer 1540 may be turned on, and data signals may be output to the data lines through the source buffers AMP1 to AMP4 and the output terminals OT1 to OT4.

Thereafter, the bias BIAS applied to the output buffer 1540 may transition to a low level at a fourteenth time point TP14, the second, fourth, sixth, and eighth switches SW2, SW4, SW6, and SW8 in the output buffer 1540 may be turned on, and a common voltage may be output through one power amplifier AMP_P.

As the display device 100 operated in the second mode, the scan signal SCAN may have pulses with a turn-on voltage level (or a low level) in some sections of the third frame section FRAME3.

Figure 18:
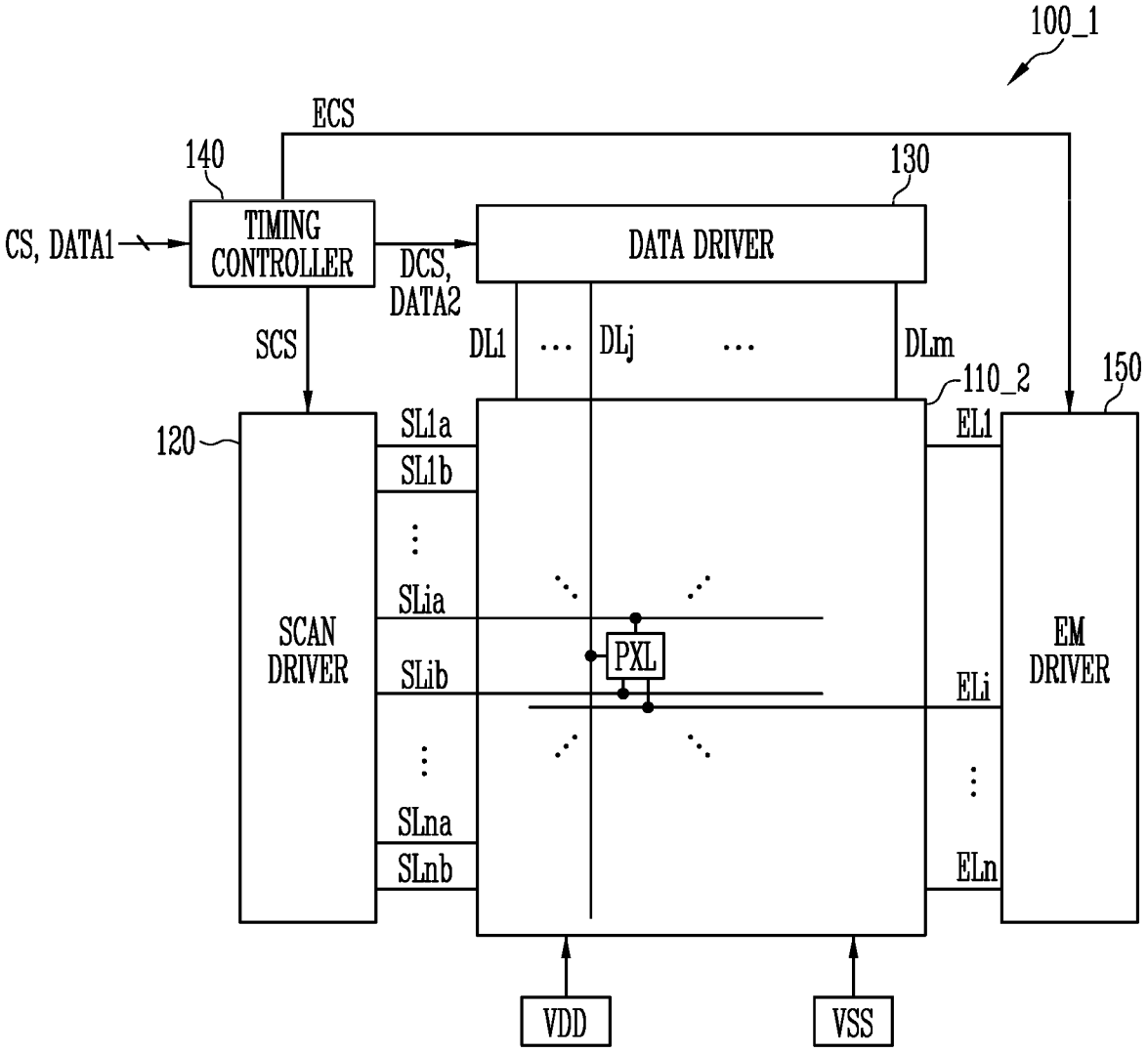
FIG. 18 is a block diagram illustrating a display device according to an example embodiment of the present disclosure.

FIG. 18 is a block diagram illustrating a display device according to an example embodiment of the present disclosure.

Referring to FIGS. 1 and 18, a display device 100_1 may be substantially the same as or similar to the display device 100 of FIG. 1, except that the display device 100_1 includes a display unit 110_2.

The display unit 110_2 may include scan lines SL1*a* to SLna and SL1*b* to SLnb. The scan lines SL1*a* to SLna and SL1*b* to SLnb may include odd-numbered scan lines SL1*a* to SLna (e.g., gate initialization lines or first scan lines) and even-numbered scan lines SL1*b* to SLnb (e.g., gate lines or second scan lines). One of the odd-numbered scan lines SL1*a* to SLna and one of the even-numbered scan lines SL1*b* to SLnb may be arranged to make a pair.

A pixel PXL may be connected to one of the first scan lines SL1*a* to SLna and one of the second scan lines SL1*b* to SLnb. For example, the pixel PXL may be connected to an ith odd-numbered scan line SLia and an ith even-numbered scan line SLib.

The pixel PXL has the pixel structure shown in FIGS. 3 and/or 4. Referring to FIG. 3, for example, the gate electrode of the second, third, and seventh transistors T2, T3, and T7 in the pixel PXL may be connected to the ith odd-numbered scan line SLia, and the gate electrode of the fourth transistor T4 may be connected to the ith even-numbered scan line SLib.

Figure 19:
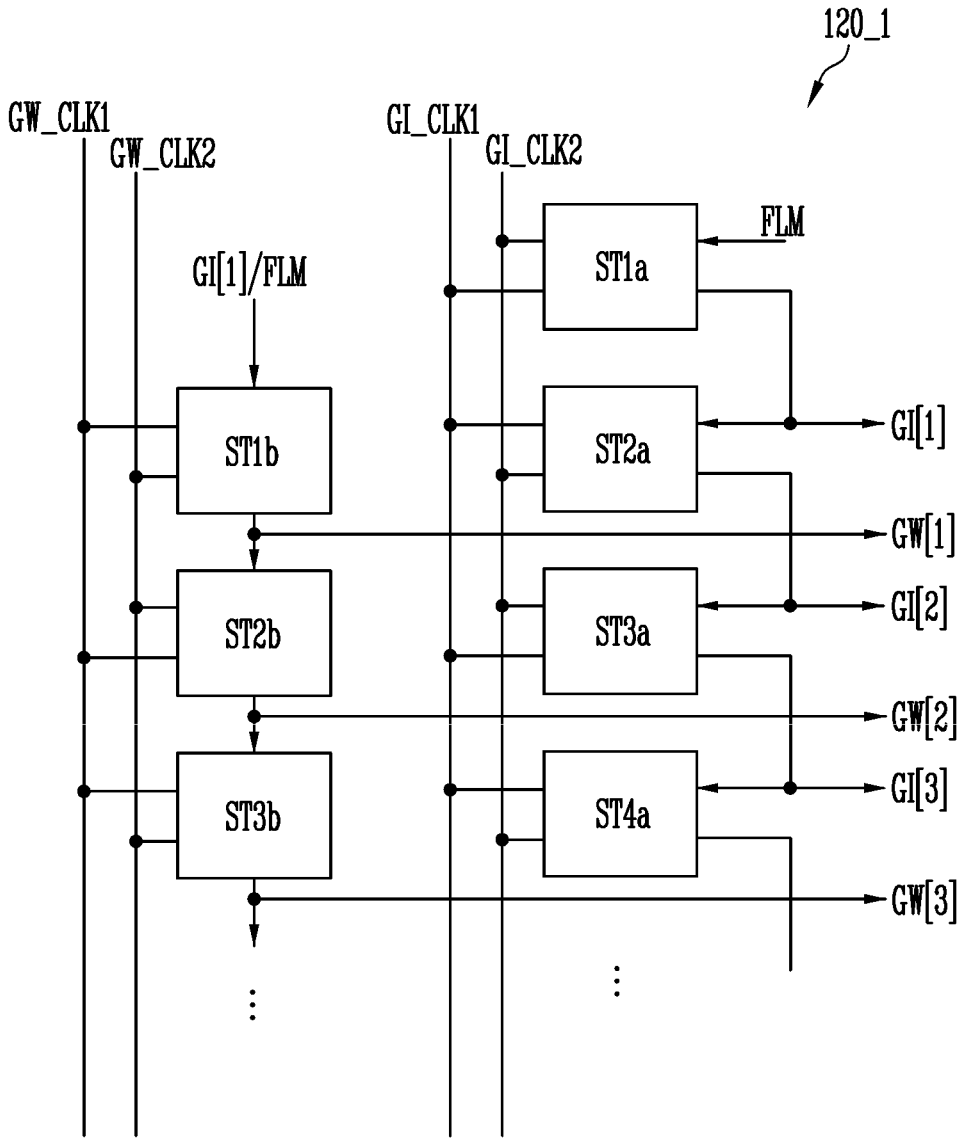
FIG. 19 is a block diagram illustrating another example of a scan driver included in the display device of FIG. 18.

FIG. 19 is a block diagram illustrating another example of a scan driver included in the display device of FIG. 18 according to an example embodiment of the present disclosure.

A scan driver 120_1 may include initialization stages ST1*a* to ST4*a* and scan stages ST1*b* to ST3*b*.

Because the connection configuration of the initialization stages ST1*a* to ST4*a* is substantially the same as or similar to the connection configuration of the stages ST1 to ST4 described with reference to FIG. 8, redundant descriptions thereof may be omitted.

The initialization stages ST1*a* to ST4*a* may be connected (e.g., alternately connected) to a first initialization clock signal GI_CLK1 and a second initialization clock signal GI_CLK2 and may be connected to odd-numbered scan lines SL1*a* to SL4*a*, respectively.

Similarly, the scan stages ST1*b* to ST3*b* may be connected (e.g., alternately connected) to the first scan clock signal GW_CLK1 and the second scan clock signal GW_CLK2 and may be connected to even-numbered scan lines SL1*b* to SL3*b*, respectively.

In the present disclosure, the first initialization stage ST1*a* may receive a start signal FLM as a carry signal and may output a first gate initialization signal GI[1]. The second initialization stage ST2*a* and the first scan stage ST1*b* may receive the first gate initialization signal GI[1] as a carry signal. Therefore, an initialization stage and a scan stage positioned in the same row may be synchronized to output a signal at the same time. For example, the third initialization stage ST3*a* may be synchronized with the second scan stage ST2*b* to output a third gate initialization signal GI[3] and a second gate signal GW[2] at the same time.

According to an example embodiment, each of the initialization stages ST1*a* to ST4*a* and the scan stages ST1*b* to ST3*b* may be substantially the same as or similar to the first stage ST1 described with reference to FIG. 9. That is, the initialization stages ST1*a* through ST4*a* may shift a carry signal by a half period and output the carry signal based on the first and second initialization clock signals GI_CLK1 and GI_CLK2. The scan stages ST1*b* to ST3*b* may also shift a carry signal by a half period and output the carry signal based on the first and second scan clock signals GW_CLK1 and GW_CLK2.

In the present disclosure, the initialization clock signals GI_CLK1 and GI_CLK2 and the scan clock signals GW_CLK1 and GW_CLK2 are illustrated in FIG. 19 as being separated from each other, but the present disclosure is not limited thereto. For example, the first initialization clock signal GI_CLK1 may have the same waveform and the same phase as the first scan clock signal GW_CLK1.

The scan driver 120_1 may separately include the initialization stages ST1*a* to ST4*a* and the scan stages ST1*b* to ST3*b* so that the display device 100_1 may further reduce the degradation of display quality.

Referring to FIGS. 3 and 12, for example, in the first masking section P_MASK1, the second clock signal CLK2 may be masked, and the fifth scan signal SCAN[5] may be skipped.

In this case, the pixel PXL that receives the fifth scan signal SCAN[5] as a current scan signal may receive the fourth scan signal SCAN[4] as a previous scan signal. The fourth transistor T4 may be turned on by the fourth scan signal SCAN[4] having a pulse with a turn-on voltage level. The initialization power voltage Vint may be transmitted to the third node N3 and may also be stored in the storage capacitor Cst. Thereafter, because the fifth scan signal SCAN[5] has a turn-off voltage level, a data voltage may not be provided to the storage capacitor Cst, and the pixel PXL may emit light in response to the initialization power voltage Vint stored in the storage capacitor Cst. In order for the pixel PXL to emit light in response to a normal data voltage, both a gate initialization signal and a gate signal may be skipped during a masking operation on clock signals.

The scan driver 120_1 according to example embodiments of the present disclosure may separately include the initialization stages ST1*a* to ST4*a* and the scan stages ST1*b* to ST3*b* to independently skip gate initialization signals and gate signals. Accordingly, the pixel PXL may be normally operated or emit light.

Figure 20:
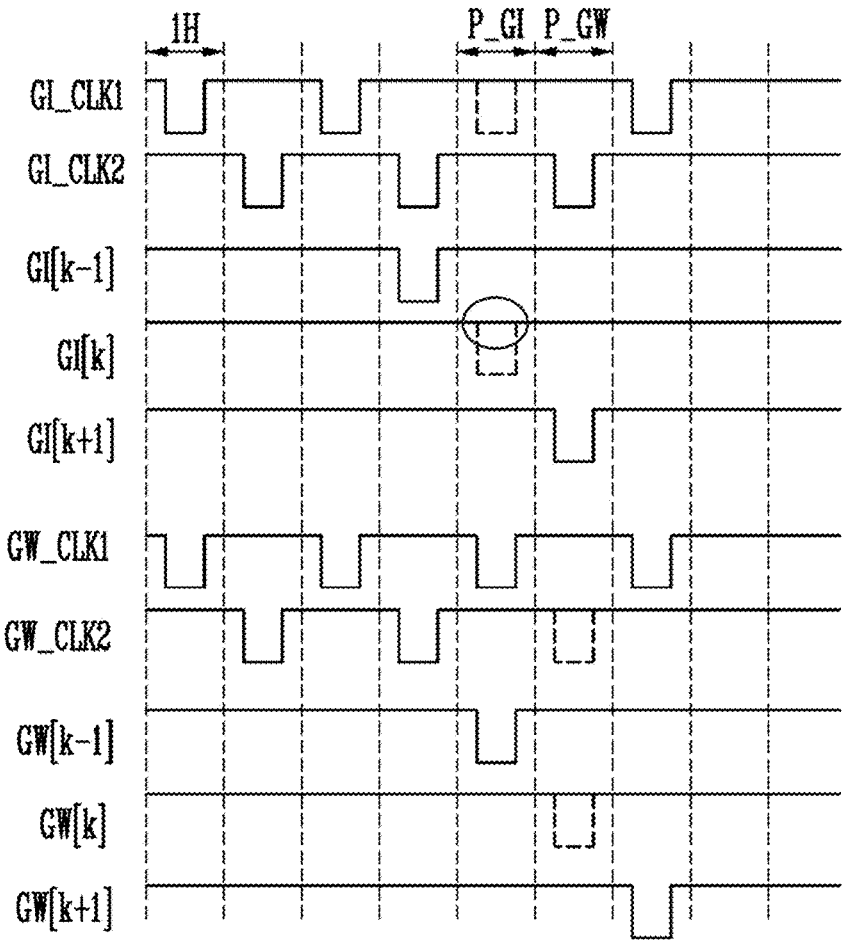
FIG. 20 is a waveform diagram illustrating operation of the scan driver of FIG. 19.

FIG. 20 is a waveform diagram illustrating operation of the scan driver of FIG. 19 according to an example embodiment of the present disclosure.

Referring to FIG. 20, first and second initialization clock signals GI_CLK1 and GI_CLK2 may be substantially the same as the first and second clock signals CLK1 and CLK2 described with reference to FIG. 12. In addition, first and second scan clock signals GW_CLK1 and GW_CLK2 may be substantially the same as the first and second clock signals CLK1 and CLK2 described with reference to FIG. 12.

In a fourth masking section P_GI, a pulse of the first initialization clock signal GI_CLK1 may be masked.

In this case, although a (k−1)th gate initialization signal GI[k−1] has a pulse with a turn-on voltage level, a kth gate initialization signal GI[k] may have a turn-off voltage level. Accordingly, initialization of a pixel which receives the kth gate initialization signal GI[k] is not performed, and the pixel may have a data signal recorded in a previous frame section. Further, a (k+1)th gate initialization signal GI[k+1] has a pulse with a turn on voltage level.

Thereafter, in a fifth masking section P_GW, a pulse of the second scan clock signal GW_CLK2 may be masked.

In this case, although a (k−1)th gate signal GW[k−1] and a (k+1)th gate signal GW[k+1] have a pulse with a turn-on voltage level, the kth gate signal GW[k] may have a turn-off voltage level. Accordingly, a data signal is not written to the pixel receiving the kth gate signal GW[k], and the pixel may have a data signal recorded in a previous frame section.

Next, when an emission control signal is applied, the pixel may emit light based on the data signal recorded in the previous frame section. That is, it is possible to reduce a phenomenon in which display quality is degraded due to a pixel emitting light with an unwanted data signal such as the initialization power voltage Vint.

According to a display device and a scan driver according to example embodiments of the present disclosure, one of clock signals may be masked in some sections of one frame section, thereby masking output of a stage corresponding to the masked clock signal, i.e., a scan signal (e.g., a gate signal or a carry signal).

In addition, in the display device, a clock signal may be maintained at a turn-off level while a scan signal is masked, thereby further reducing power consumption. A wake-up pulse may be applied to a clock signal at a low frequency while a scan signal is masked, thereby preventing display quality from being degraded.

It is noted that although the technical spirit of the present disclosure described above is specifically described in the example embodiments, the aforementioned example embodiments are for illustrative purposes and not to limit the present disclosure. Further, those skilled in the art will appreciate that various modifications may be made without departing from the scope and spirit of the present disclosure.

The scope of the present disclosure is not limited to the details described in the detailed description of the specification but may be defined by the claims. In addition, it shall be understood that all modifications and embodiments conceived from the meaning and scope of the claims and their equivalents are included in the scope of the present disclosure.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

What is claimed is:

1. A display device comprising:

a timing controller configured to generate clock signals, a start signal, and image data;

a scan driver comprising a plurality of stages configured to sequentially output the clock signals as scan signals in response to the start signal;

a data driver configured to generate a data signal based on the image data; and a display unit comprising a plurality of pixels configured to emit light with luminance corresponding to the data signal in response to the scan signals, wherein the timing controller is configured to mask, while the data driver generates the data signal based on the image data, at least one of the clock signals in a first period, a second period, and a third period included in one frame period and spaced from each other, wherein the clock signals comprise a first clock signal and a second clock signal, and wherein, in the first period of the one frame period, the timing controller is to mask the second clock signal and is not to mask the first clock signal.

2. The display device of claim 1, wherein each of the plurality of stages is to output a clock signal of the clock signals as a scan signal of the scan signals in response to a carry signal, wherein a first stage of the plurality of stages is to receive the start signal as the carry signal, and wherein remaining stages of the plurality of stages other than the first stage is to receive a scan signal of a previous stage of the plurality of stages as the carry signal.

3. The display device of claim 2, wherein:

the first clock signal has a pulse waveform, and the second clock signal is a signal in which the first clock signal is shifted by a half period.

4. The display device of claim 3, wherein:

the first stage of the plurality of stages is to output the second clock signal as the scan signal, and a second stage of the plurality of stages adjacent to the first stage is to output the first clock signal as the scan signal.

5. The display device of claim 3, wherein the second clock signal comprises a pulse having a first voltage level between a first time point and a second time point and is maintained at a second voltage level different from the first voltage level between a third time point and a fourth time point, wherein the first time point, the second time point, the third time point, and the fourth time point are sequentially spaced by a half period of the second clock signal, and wherein the third time point and the fourth time point are in the first period.

6. The display device of claim 5, wherein the first clock signal comprises a pulse having the first voltage level between the second time point and the third time point and a pulse having the first voltage level between the fourth time point and a fifth time point, and wherein the fifth time point is spaced from the fourth time point by a half period of the first clock signal.

7. The display device of claim 3, wherein the first period corresponds to at least one stage of the plurality of stages.

8. The display device of claim 7, wherein the first period is smaller than a period of the first clock signal.

9. The display device of claim 3, wherein the timing controller is to mask at least one of the first clock signal and the second clock signal in the second period.

10. The display device of claim 9, wherein the second period is greater than a period of the first clock signal.

11. The display device of claim 3, wherein the timing controller is to mask at least one of the first clock signal and the second clock signal in the third period.

12. The display device of claim 11, wherein the third period is greater than a period of the first clock signal.

13. A display device comprising:

a timing controller configured to generate clock signals, a start signal, and image data;

a scan driver comprising a plurality of stages configured to sequentially output the clock signals as scan signals in response to the start signal;

a data driver configured to generate a data signal based on the image data; and a display unit comprising a plurality of pixels configured to emit light with luminance corresponding to the data signal in response to the scan signals, wherein:

the timing controller is configured to mask, while the data driver generates the data signal based on the image data, at least one of the clock signals in a first period, a second period, and a third period included in one frame period and spaced from each other;

each of the plurality of stages is to output a clock signal of the clock signals as a scan signal of the scan signals in response to a carry signal;

a first stage of the plurality of stages is to receive the start signal as the carry signal;

remaining stages of the plurality of stages other than the first stage is to receive a scan signal of a previous stage of the plurality of stages as the carry signal;

the clock signal comprises a first clock signal and a second clock signal;

the first clock signal has a pulse waveform;

the second clock signal is a signal in which the first clock signal is shifted by a half period; and each of the first clock signal and the second clock signal has at least one pulse between the second period and the third period.

14. A display device comprising:

a timing controller configured to generate clock signals, a start signal, and image data;

a scan driver comprising a plurality of stages configured to sequentially output the clock signals as scan signals in response to the start signal;

a data driver configured to generate a data signal based on the image data; and a display unit comprising a plurality of pixels configured to emit light with luminance corresponding to the data signal in response to the scan signals, wherein the timing controller is configured to mask at least one of the clock signals in a first period, a second period, and a third period included in one frame period and spaced from each other, and wherein the timing controller is to output pulses of a clock signal of the clock signals in a first mode, to mask at least one of the pulses of the clock signal in the first period, the second period, and the third period in a second mode, and to periodically perform a mode conversion between the first mode and the second mode.

15. The display device of claim 14, wherein each of the pixels of the plurality of pixels comprises:

a light-emitting element;

a first transistor comprising a first electrode connected to a first power source, a second electrode connected to a first node, a gate electrode connected to a second node, and a body configured to receive a common control voltage;

a second transistor configured to transmit the data signal to the second node in response to a scan signal of the scan signals; and a third transistor connecting the first node and the light-emitting element.

16. The display device of claim 15, wherein the common control voltage having a first voltage level is applied to the pixels in the first mode, and wherein the common control voltage having a second voltage level different from the first voltage level is applied to some of the pixels in the second mode.

17. The display device of claim 15, wherein the display unit comprises a first pixel region and a second pixel region that are separated from each other, wherein each of first pixels in the first pixel region from among the pixels is connected to a first common control line to receive the common control voltage, and wherein each of second pixels in the second pixel region from among the pixels is connected to a second common control line to receive the common control voltage.

18. A display device comprising:

a timing controller configured to generate a first clock signal, a second clock signal, a start signal, and image data;

a scan driver comprising a plurality of stages, wherein the stages are to sequentially output a first scan signal corresponding to the start signal based on the first clock signal and to output a second scan signal corresponding to the first scan signal based on the second clock signal;

a data driver configured to generate a data signal based on the image data; and a display unit comprising pixels, wherein each of the pixels is configured to be initialized in response to the first scan signal and to emit light with luminance corresponding to the data signal in response to the second scan signal, wherein the timing controller is to mask at least one of the first clock signal and the second clock signal in a first period included in one frame period.

* * * * *